US006130507A

United States Patent [19]

Maishev et al.

[11] Patent Number: 6,130,507

[45] Date of Patent: Oct. 10, 2000

[54] COLD-CATHODE ION SOURCE WITH PROPAGATION OF IONS IN THE ELECTRON DRIFT PLANE

[75] Inventors: Yuri Maishev, Moscow, Russian Federation; James Ritter, Freemont, Calif.; Yuri Terentiev, Moscow, Russian Federation; Leonid Velikov, San Carlos, Calif.

[73] Assignee: Advanced Ion Technology, Inc, Freemont, Calif.

[21] Appl. No.: 09/161,581

[22] Filed: Sep. 28, 1998

[51] Int. Cl.[7] ..... H01J 27/02

[52] U.S. Cl. ..... 315/111.81; 315/111.91; 250/423 R; 250/492.21

[58] Field of Search ..... 315/111.81, 111.91; 250/423 R, 426, 492.21, 492.3

[56] References Cited

U.S. PATENT DOCUMENTS

| | | | |
|---|---|---|---|
| 4,122,347 | 10/1978 | Kovlasky et al. | 250/423 R |
| 4,710,283 | 12/1987 | Singh et al. | 315/111.81 X |
| 6,002,208 | 12/1999 | Maishev et al. | 315/111.91 |

FOREIGN PATENT DOCUMENTS 2030807 of 1995 Russian Federation .

OTHER PUBLICATIONS

Harold Kaufman, et al. Handbook of Ion Beam Processing Technology. (Edited by J. Cuomo, and S. Rossnagel). Noyes Publications, USA, pp. 8–20, 1989.

*Primary Examiner*—Justin P. Bettendorf
*Attorney, Agent, or Firm*—I. Zborovsky

[57] ABSTRACT

The ion source of the invention emits ion beams radially inwardly or radially outwardly from the entire periphery of the closed-loop ion-emitting slit. In one embodiment, a tubular or oval-shaped hollow body, which also functions as a cathode, contains a similarly-shaped concentric anode spaced from the inner walls of the cathode at a distance required to form an ion-generating and accelerating space. The cathode has a continuous ion-emitting slit which is aligned with the position of the anode and is concentric thereto. A magnetic-field generation means is located inside the ring-shaped anode. When the ion source is energized by inducing an magnetic field, connecting the anode to a positive pole of the electric power supply unit, the cathode to a negative pole of the power supply unit, and supplying a working medium into the hollow housing, the electrons begin to drift in the annular space between the anode and cathode in the same direction in which the ions are emitted from the annular slit. By rearranging positions of magnet, anode, and cathode, it is possible to provide emission of ions in the inward or outward direction for treating outer or inner surfaces of tubular objects.

26 Claims, 17 Drawing Sheets

COLD-CATHODE ION SOURCE WITH PROPAGATION OF IONS IN THE ELECTRON DRIFT PLANE

FIELD OF THE INVENTION

The present invention relates to ion-emission technique, particularly to cold-cathode ion sources used for treating internal or external surfaces of objects with a continuous radially-emitted ion beams. More specifically, the invention relates to a universal cold-cathode type ion sources with propagation of ions in the electron drift plane.

BACKGROUND OF THE INVENTION AND DESCRIPTION OF THE PRIOR ART

An ion source is a device that ionizes gas molecules and then focuses, accelerates, and emits them as a narrow beam. This beam is then used for various technical and technological purposes such as cleaning, activation, polishing, thin-film coating, or etching.

An example of an ion source is the so-called Kaufman ion source, also known as a Kaufman ion engine or an electron-bombardment ion source described in U.S. Pat. No. 4,684,848 issued to H. R. Kaufman in 1987.

This ion source consists of a discharge chamber in which a plasma is formed, and an ion-optical system which generates and accelerates an ion beam to an appropriate level of energy. A working medium is supplied to the discharge chamber which contains a hot cathode that functions as a source of electrons and is used for firing and maintaining a gas discharge. The plasma, which is formed in the discharge chamber, acts as an emitter of ions and creates, in the vicinity of the ion-optical system, an ion-emitting surface. As a result, the ion-optical system extracts ions from the aforementioned ion-emitting surface, accelerates them to a required energy level, and forms an ion beam of a required configuration. Typically, aforementioned ion sources utilize two-grid or three-grid ion-optical systems. A disadvantage of such a device is that it requires the use of ion accelerating grids and an ion beam of low intensity.

Attempts have been made to provide ion sources with ion beams of higher intensity by holding the electrons in a closed space between a cathode and an anode where the electrons could be held. For example, U.S. Pat. No. 4,122,347 issued in 1978 to Kovalsky et al. describes an ion source with a closed-loop of electrons for ion-beam etching and deposition of thin films, wherein the ions are taken from the boundaries of a plasma formed in a gas-discharge chamber with a hot cathode. The ion beam is intensified by a flow of electrons which is held in crossed electrical and magnetic fields within the accelerating space and which compensates for the positive spatial charge of the ion beam.

A disadvantage of the devices of such type is that it does not allow formation of ion beams of chemically-active substances for ion beams capable of treating large surface areas. Other disadvantages of the aforementioned device are short service life and high non-uniformity of ion beams.

U.S. Pat. No. 4,710,283 issued in 1997 to Singh et al. describes a cold-cathode type ion source with crossed electric and magnetic fields for ionization of a working substance wherein entrapment of electrons and generation of the ion beam are performed with the use of a grid-like electrode. This source is advantageous in that it forms belt-like and tubular ion beams emitted in one or two opposite directions.

However, the ion source with a grid-like electrode of the type disclosed in U.S. Pat. No. 4,710,283 has a number of disadvantages consisting in that the grid-like electrode makes it difficult to produce an extended ion beam and in that the ion beam is additionally contaminated as a result of sputtering of the material from the surface of the grid-like electrode. Furthermore, with the lapse of time the grid-like electrode is deformed whereby the service life of the ion source as a whole is shortened.

Other publications (e.g., Kaufman H. R. et al. (End Hall Ion Source, J. Vac. Sci. Technol., Vol. 5, July/August, 1987, pp. 2081–2084; Wykoff C. A. et al., 50-cm Linear Gridless Source, Eighth International Vacuum Web Coating Conference, Nov. 6–8, 1994)) disclose an ion source that forms conical or belt-like ion beams in crossed electrical and magnetic fields. The device consists of a cathode, a hollow anode with a conical opening, a system for the supply of a working gas, a magnetic system, a source of electric supply, and a source of electrons with a hot cathode. A disadvantage of this device is that it requires the use of a source of electrons with a hot or hollow cathode and that it has electrons of low energy level in the zone of ionization of the working substance. These features create limitations for using chemically-active working substances. Furthermore, a ratio of the ion-emitting slit width to a cathode-anode distance is significantly greater than 1, and this decreases the energy of electrons in the charge gap, and hence, hinders ionization of the working substance. Configuration of the electrodes used in the ion beam of such sources leads to a significant divergence of the ion beam. As a result, the electron beam cannot be delivered to a distant object and is to a greater degree subject to contamination with the material of the electrode. In other words, the device described in the aforementioned literature is extremely limited in its capacity to create an extended uniform belt-like ion beam. For example, at a distance of 36 cm from the point of emission, the beam uniformity did not exceed ±7%.

Russian Patent No. 2,030,807 issued in 1995 to M. Parfenyonok, et al. describes an ion source that comprises a magnetoconductive housing used as a cathode having an ion-emitting slit, an anode arranged in the housing symmetrically with respect to the emitting slit, a magnetomotance source, a working gas supply system, and a source of electric power supply.

FIGS. 1 and 2 schematically illustrate aforementioned known ion source with a circular ion-beam emitting slit. More specifically, FIG. 1 is a sectional side view of an ion-beam source with a circular ion-beam emitting slit, and FIG. 2 is a sectional plan view along line II—II of FIG. 1.

The ion source of FIGS. 1 and 2 has a hollow cylindrical housing 40 made of a magnetoconductive material such as Armco steel (a type of a mild steel), which is used as a cathode. Cathode 40 has a cylindrical side wall 42, a closed flat bottom 44 and a flat top side 46 with a circular ion emitting slit 52.

A working gas supply hole 53 is formed in flat bottom 44. Flat top side 46 functions as an accelerating electrode. Placed inside the interior of hollow cylindrical housing 40 between bottom 44 and top side 46 is a magnetic system in the form of a cylindrical permanent magnet 66 with poles N and S of opposite polarity. An N-pole faces flat top side 46 and S-pole faces bottom side 44 of the ion source. The purpose of a magnetic system 66 with a closed magnetic circuit formed by parts 66, 40, 42, and 44 is to induce a magnetic field in ion emitting slit 52. It is understood that this magnetic system is shown only as an example and that it can be formed in a manner described, e.g., in aforementioned U.S. Pat. No. 4,122,347. A circular annular-shaped anode 54 which is connected to a positive pole 56*a* of an electric power source 56 is arranged in the interior of housing 40 around magnet 66 and concentric thereto. Anode 54 is fixed inside housing 40 by means of a ring 48 made of non-magnetic dielectric material such as ceramic. Anode 54 has a central opening 55 in which aforementioned permanent magnet 66 is installed with a gap between the outer surface of the magnet and the inner wall of opening 55. A negative pole 56*b* of electric power source is connected to housing 40 which is grounded at GR.

Located above housing 40 of the ion source of FIGS. 1 and 2 is a sealed vacuum chamber 57 which has an evacuation port 59 connected to a source of vacuum (not shown). An object OB to be treated is supported within chamber 57 above ion emitting slit 52, e.g., by gluing it to an insulator block 61 rigidly attached to the housing of vacuum chamber 57 by a bolt 63 but so that object OB remains electrically and magnetically isolated from the housing of vacuum chamber 57. However, object OB is electrically connected via a line 56*c* to negative pole 56*b* of power source 56. Since the interior of housing 40 communicates with the interior of vacuum chamber 57, all lines that electrically connect power source 56 with anode 54 and object OB should pass into the interior of housing 40 and vacuum chamber 57 via conventional commercially-produced electrical feedthrough devices which allow electrical connections with parts and mechanisms of sealed chambers without violation of their sealing conditions. In FIG. 1, these feedthrough devices are shown schematically and designated by reference numerals 40*a* and 57*a*. Reference numeral 57*b* designates a seal for sealing connection of vacuum chamber 57 to housing 40.

The known ion source of the type shown in FIGS. 1 and 2 is intended for the formation of a unilaterally directed tubular ion beam. The source of FIGS. 1 and 2 forms a tubular ion beam IB emitted in the direction of arrow A and operates as follows.

Vacuum chamber 57 is evacuated, and a working gas is fed into the interior of housing 40 of the ion source. A magnetic field is generated by magnet 66 in the accelerating gap between anode 54 and cathode 40, whereby electrons begin to drift in a closed path within the crossed electrical and magnetic fields. A plasma 58 is formed between anode 54 and cathode 40. When the working gas is passed through the ionization gap, tubular ion beam IB, which is propagated in the axial direction of the ion source shown by an arrow A, is formed in the area of an ion-emitting slit 52 and in an accelerating gap 52*a* between anode 54 and cathode 40.

The above description of the electron drift is simplified to ease understanding of the principle of the invention. In reality, the phenomenon of generation of ions in the ion source with a closed-loop drift of electrons in a crossed electric and magnetic fields is of a more complicated nature and consists in the following.

When, at starting the ion source, a voltage between anode 54 and cathode 40 reaches a predetermined level, a gas discharge occurs in anode-cathode gap 52*a*. As a result, the electrons, which have been generated as a result of ionization, begin to migrate towards anode 54 under the effect of collisions and oscillations. After being accelerated by the electric field, the ions pass through ion-emitting slit 52 and are emitted from the ion source. Inside the ion-emitting slit, the crossed electric and magnetic fields force the electrons to move along closed cycloid trajectories. This phenomenon is known as "magnetization" of electrons. The magnetized electrons remain drifting in a closed space between two parts of the cathode, i.e., between those facing parts of cathode 40 which form ion-emitting slit 52. The radius of the cycloids is, in fact, the so-called doubled Larmor radius RL which is represented by the following formula:

$$R_L = meV/|e|B,$$

where m is a mass of the electron, B is the strength of the magnetic field inside the slit, V is a velocity of the electrons in the direction perpendicular to the direction of the magnetic field, and |e| is the charge of the electron.

It is required that the height of the electron drifting space in the ion-emission direction be much greater than the aforementioned Larmor radius. This means that a part of the ionization area penetrates into ion-emitting slit 52 where electrons can be maintained in a drifting state over a long period of time. In other words, a spatial charge of high density is formed in ion-emitting slit 52.

When a working medium, such as argon which has neutral molecules, is injected into the slit, the molecules are ionized by the electrons present in this slit and are accelerated by the electric field. As a result, the thus formed ions are emitted from the slit towards the object. Since the spatial charge has high density, an ion beam of high density is formed. This beam can be converged or diverged by known technique for specific applications.

Thus, the electrons do not drift in a plane, but rather along cycloid trajectories across ion-emitting slit 52. However, for the sake of convenience of description, here and hereinafter, as well as in the title of the invention and in the claims, the term "electron drifting plane" will be used.

The diameter of the tubular ion beam formed by means of such an ion source may reach 500 mm and more.

The ion source of the type shown in FIG. 1 is not limited to a cylindrical configuration and may have an elliptical or an oval-shaped cross section as shown in FIG. 3. In FIG. 3 the parts of the ion beam source that correspond to similar parts of the previous embodiment are designated by the same reference numerals with an addition of subscript OV. Structurally, this ion source is the same as the one shown in FIG. 1 with the exception that a cathode $\mathbf{40}_{ov}$, anode $\mathbf{54}_{ov}$, a magnet $66_{ov}$, and hence an emitting slit (not shown in FIG. 3), have an oval-shaped configuration. As a result, a belt-like ion beam having a width of up to 1400 mm can be formed. Such an ion beam source is suitable for treating large-surface objects when these objects are passed over ion beam IB emitted through emitting slit 52.

With 1 to 3 kV voltage on the anode and various working gases, this source makes it possible to obtain ion beams with currents of 0.5 to 1 A. In this case, an average ion energy is within 400 to 1500 eV, and a nonuniformity of treatment over the entire width of a 1400 mm-wide object does not exceed ±5%.

Nevertheless, the aforementioned belt-type ion source, as well as any other existing ion sources of this type known to the applicants, propagate ions in the direction perpendicular to the plane of drift of electrons. However, ion sources of this type have some limitations with regard to the ion-emission geometry, e.g., they are unable to treat the inner or outer surfaces of a tubular or oval-shaped bodies with continuous radially-emitted ion beams. This is because, if a closed-loop emitting slit that has the plane of electron drift perpendicular to the ion propagation direction is applied onto a cylindrical surface, there should always be a solid magnetoconductive partition for closing the electron drift circuit, i.e., for transferring electrons in the plane of drift from one polepiece to another polepiece of the ion-emitting slit. This means that in treating, e.g., an inner or an outer surface of the tube, there always be an untreated portion on the aforementioned surface, so that the tube should either be rotated during the treatment or treated at least twice.

OBJECTS OF THE INVENTION

It is an object of the invention to provide an ion source with a closed-loop configuration of the ion emitting slit which allows for simultaneously treating the entire outer or inner surface of an object with a continuous radially-emitted ion beams.

Another object is to provide a method for simultaneously treating the entire inner or outer surfaces of objects with the use of a closed-loop radially emitting slits.

BRIEF DESCRIPTION OF THE DRAWINGS

FIG. 20 is a schematic sectional view of an sputtering system with an ion beam moveable with respect to the target.

SUMMARY OF THE INVENTION

The ion source of the invention emits ion beams radially inwardly or radially outwardly from the entire periphery of the closed-loop ion-emitting slit. In one embodiment, a tubular or oval-shaped hollow body, which also functions as a cathode, contains a similarly-shaped concentric anode spaced from the inner walls of the cathode at a distance required to form an ion-generating and accelerating space. The cathode has a continuous ion-emitting slit which is aligned with the position of the anode and is concentric thereto. A magnetic-field generation means is located inside the ring-shaped anode. When the ion source is energized by inducing a magnetic field, connecting the anode to a positive pole of the electric power supply unit, the cathode to a negative pole of the power supply unit, and supplying a working medium into the hollow housing, the electrons begin to drift in the annular space between the anode and cathode in the same direction in which the ions are emitted from the annular slit. By rearranging positions of magnet, anode, and cathode, it is possible to provide emission of ions in the inward or outward direction for treating outer or inner surfaces of tubular objects. The invention also provides a specific arrangement of target holders for multiple-component sputtering which is suitable for location of the sputtering apparatus in lengthy and narrow tunnel-type heating ovens or sputtering chambers for deposition of thin coatings on elongated articles or on a plurality of articles transported by pallets or conveyors. The invention also provides a sputtering system comprising target holders in combination with aforementioned ion source for the formation of multiple-component coatings on the objects.

DETAILED DESCRIPTION OF THE INVENTION

The invention will be now described in more detail with reference to different embodiments which differ from each other by mutual locations and configurations of magnets, anodes, cathodes, ion-emitting slits, and electric power supply units. These differences determine the direction of emission of ions and performance characteristics of the ion sources. However, what is common for all the embodiments of the invention is that the ion-emitting slit has a closed-loop configuration and that the direction of emission of electrons lies in the plane of drift of electrons.

Figure 1:
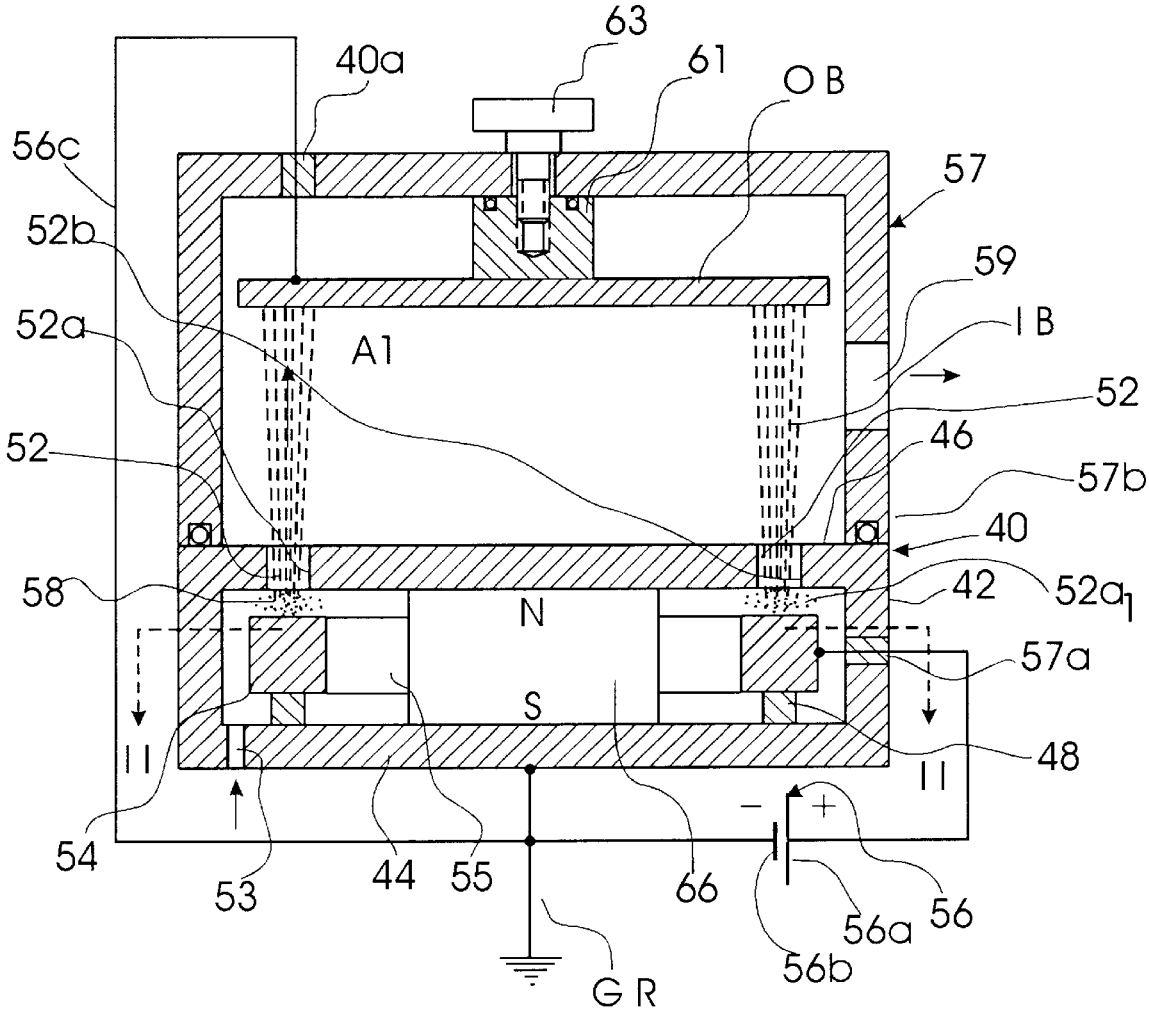
FIG. 1 PRIOR ART
FIG. 1 is a sectional side view of a known ion-beam source with a circular ion-beam emitting slit.
Figure 2:
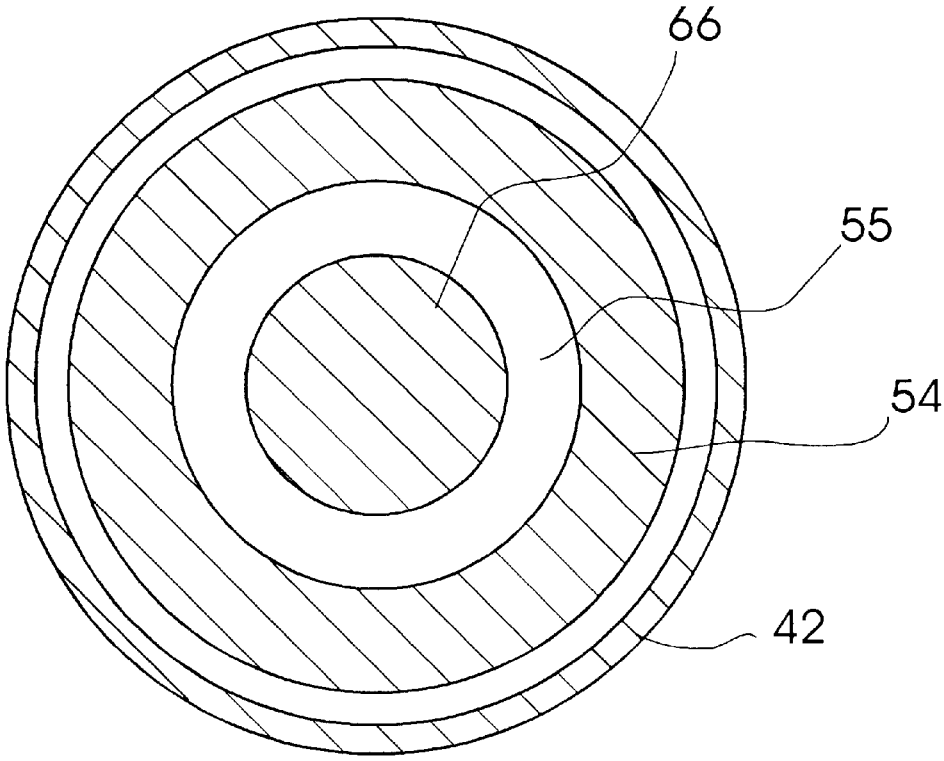
FIG.2 PRIOR ART
FIG. 2 is a sectional plan view along line II—II of FIG. 1.
Figure 3:
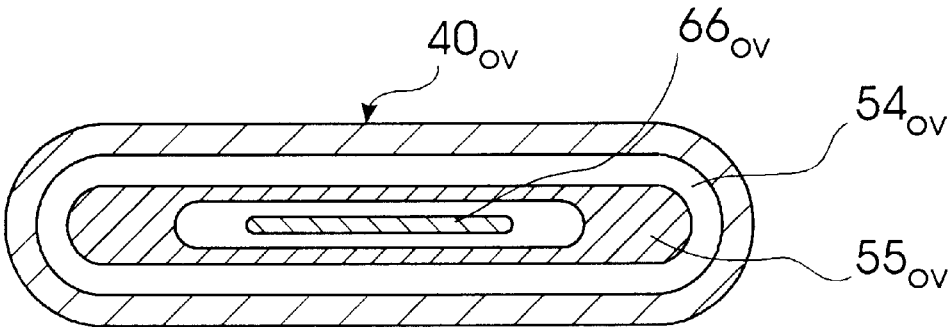
FIG.3 PRIOR ART
FIG. 3 is a sectional plan view similar to the one of FIG. 2, but with an oval-shaped sectional configuration of the ion-emitting slit.
Figure 4:
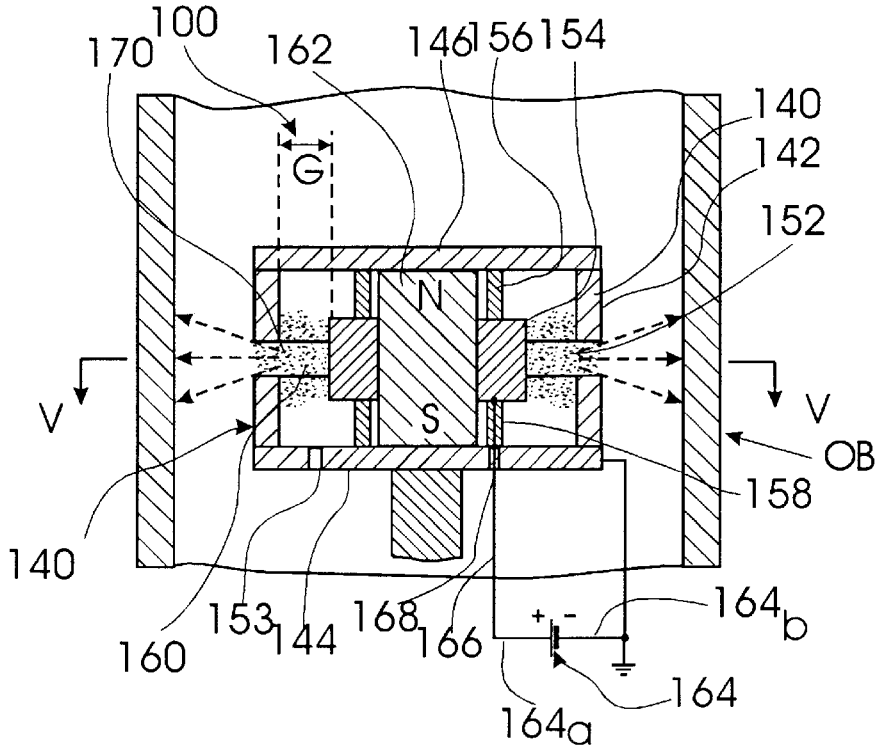
FIG. 4 is a longitudinal sectional view of a closed-loop ion source of the invention for emission of ion beams in a radial outward direction in a plane of drift of electrons.
Figure 5A:
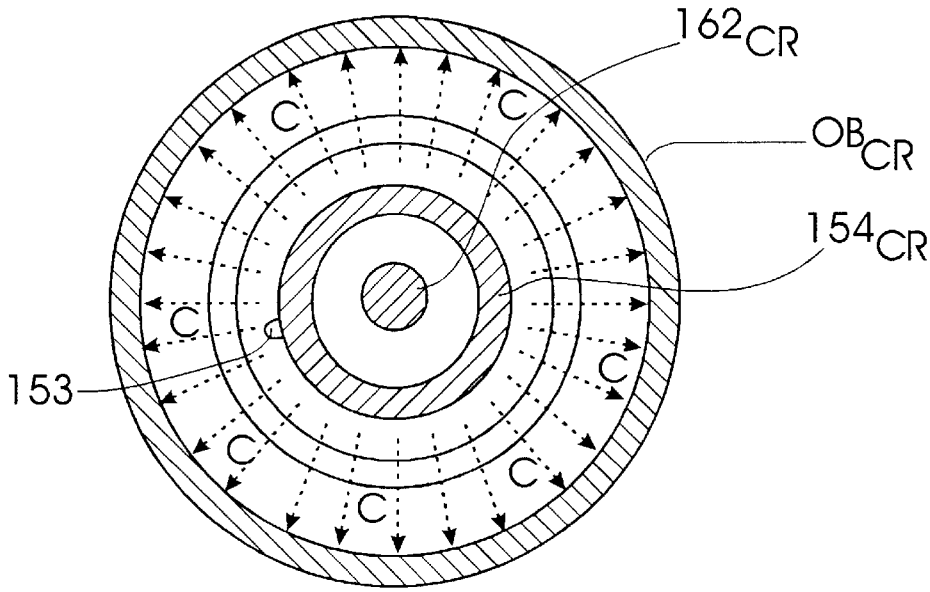
FIG. 5A is a view similar to FIG. 5 illustrating a circular cylindrical shape of the ion beam source housing, anode, magnet, and object being treated.
Figure 5:
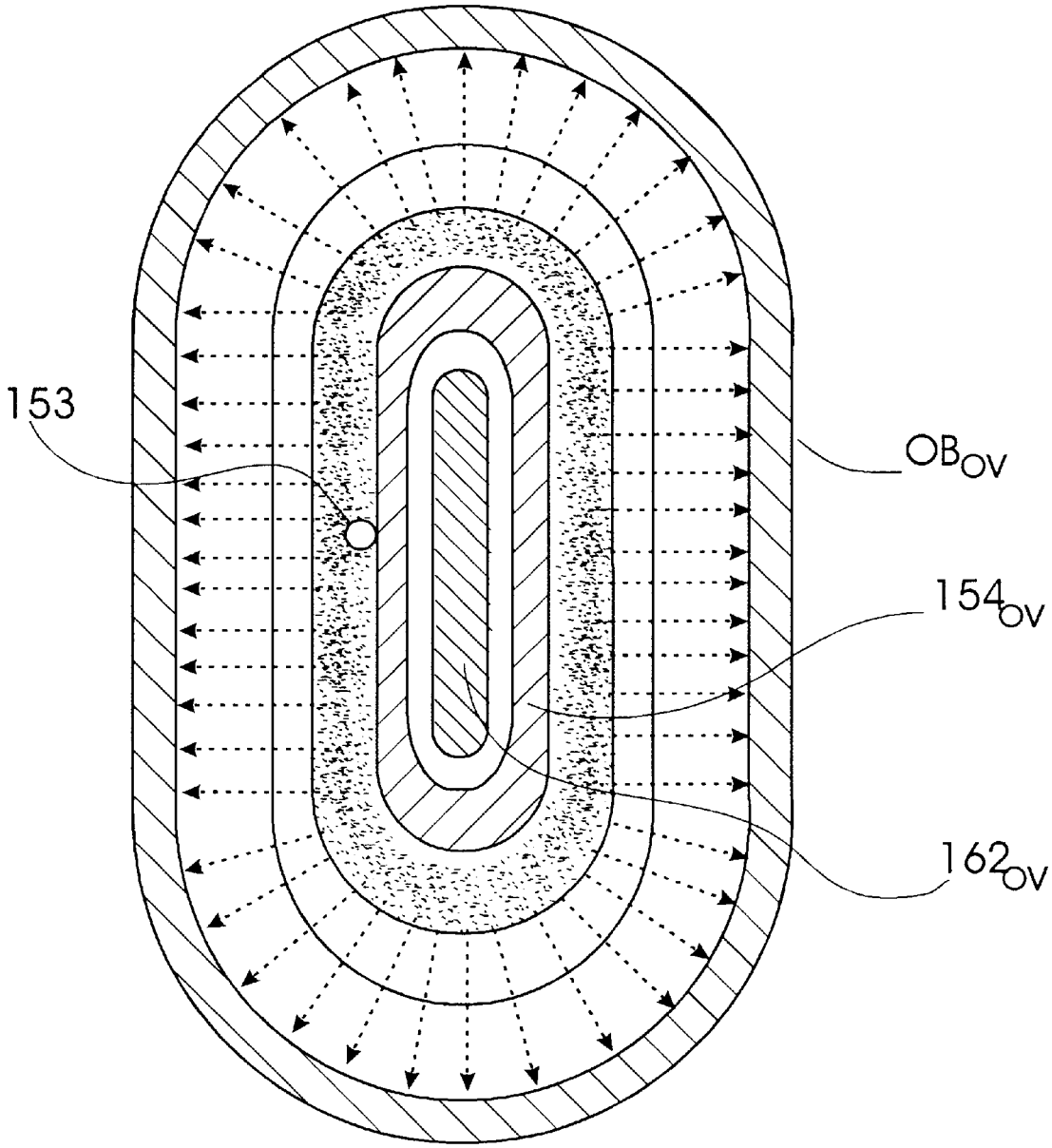
FIG. 5 is a sectional view of the ion source in the direction of line V—V of FIG. 4 illustrating an oval cross-section of the ion beam source housing, anode, magnet, and object being treated.

FIGS. 4, 5 and 5A—A Single-Slit Ion Source of the Invention for Emission of Ion Beams in a Radial Outward Direction in a Plane of Drift of Electrons FIG. 4 is a sectional view of a closed-loop ion source of the invention for emission of ion beams in a radial outward direction in a plane of drift of electrons, and FIG. 5 is a sectional view of the ion source in the direction of line V—V of FIG. 4 illustrating an oval cross-section of the ion beam source housing, anode, magnet, and object being treated. The aforementioned parts may have a circular, oval, or any other suitable form.

It is understood that, strictly speaking, oval or ellipse do not have a radial direction and that words are applicable to a circle only. However, for the same of convenience, here and hereinafter, including patent claims, the terms "radially inwardly" and "radially outwardly" will be used in connection with any closed-loop configuration of the ion-emitting slit from which the ion beams are emitted inwardly or outwardly perpendicular to the circumference of the ion-beam housing.

In FIGS. 5 and 5A, which illustrate cross-sectional shapes of the parts of the ion source, those parts which have an oval shape are designated with an addition of subscripts $_{ov}$ whereas circular-shaped parts are designated with an addition of subscripts An ion source of this embodiment, which in general is designated by reference numeral 100, has a hollow housing 140 made of a magnetoconductive material which is used as a cathode. In the embodiment of FIGS. 4 and 5, housing 140 has an oval-shaped configuration which is shown only for illustrative purposes, since the housing may be cylindrical or elliptical, or may have any other suitable configuration.

FIG. 5A is a view similar to FIG. 5 illustrating an ion beam source having a circular cylindrical housing, anode $\mathbf{154}_{cr}$, magnet $\mathbf{162}_{cr}$, and tubular object OB being treated. This embodiment does not need detailed explanation as all the parts are the same as in FIG. 5 with the exception that the ion source of this embodiment is intended for treating inner surfaces of cylindrical tubular objects.

Housing 140 has a closed flat bottom 144 and a flat top side 146 with a through closed-loop ion-emitting slit 152 formed in the wall of housing 140 around its entire periphery, approximately in the middle of the height of the housing.

A working gas supply hole 153 is also formed in the side wall of housing 140.

Hollow housing or cathode 140 contains a similarly-shaped concentric anode 154 which is fixed inside the housing by means of appropriately shaped bodies 156 and 158 of a nonmagnetic dielectric material, such as aluminum ceramic. Anode 154 is spaced from the inner walls of cathode 140 at a radial distance G required to form an ionization space 160. In the direction of the height of housing 140, anode 154 is aligned with the position of closed-loop slit 152.

A magnetic-field generation means, which in this embodiment is shown as a permanent magnet 162, is located inside anode 154 and is spaced from the inner surface of the anode. As shown in FIG. 5, magnet 162 is concentric to anode 154 and housing 140 and also has an oval-shaped configuration. It is understood that upper and lower parts 146 and 144 as well as adjacent parts of housing 140 which form ion-emitting slit 152 should be electrically connected. This is achieved by making magnet 162 of a conducive material, e.g., such as SmCo alloy. Alternatively, when an electromagnet is used, these parts may be connected via conductors (not shown).

Anode 154 is electrically connected to a positive pole 164*a* of an electric power supply unit 164 by a conductor line 166 which passes into housing 140 via a conventional electric feedthrough 168. Cathode 140 is electrically connected to a negative pole 164*b* of power supply unit 164.

In operation, vacuum chamber (not shown) or object OB is evacuated, and a working gas is fed into the interior of housing 140 of ion source 100 via inlet opening 153. A magnetic field is generated by permanent magnet 162 in ionization gap 160 (FIG. 4) between anode 154 and cathode 140, whereby electrons begin to drift in a closed path within the crossed electrical and magnetic fields. In the case of the device of the invention, the electrons begin to drift in annular space 160 between anode 154 and cathode 160 in the same direction in which the ions are emitted from the annular slit, i.e., in the radial outward direction shown by arrow C in FIG. 4 and by a plurality of arrows C in FIG. 5 (see more detailed explanation of the phenomenon given above on page 7).

A plasma 170 is formed between anode 154 and cathode 140 and partially inside ion-emitting slit 152. When the working gas is passed through ionization and acceleration gap G, ion beam IB, which propagates outwardly in the direction shown by arrows C, is formed in the area of ion-emitting slit 152 and in accelerating gap G between anode 154 and cathode 140.

Ion source 100 of this embodiment is suitable for treating inner surfaces of tubular bodies. In this embodiment a tubular body OB is shown as a tube of a circular cross section in FIG. 5*a* and of an oval cross section in FIG. 5.

It is understood that object OB and hence ion source 100 are located in a vacuum chamber (not shown) which may be identical to the one described in connection with the prior art. It is also understood that the object itself can be sealed and evacuated.

Figure 6:
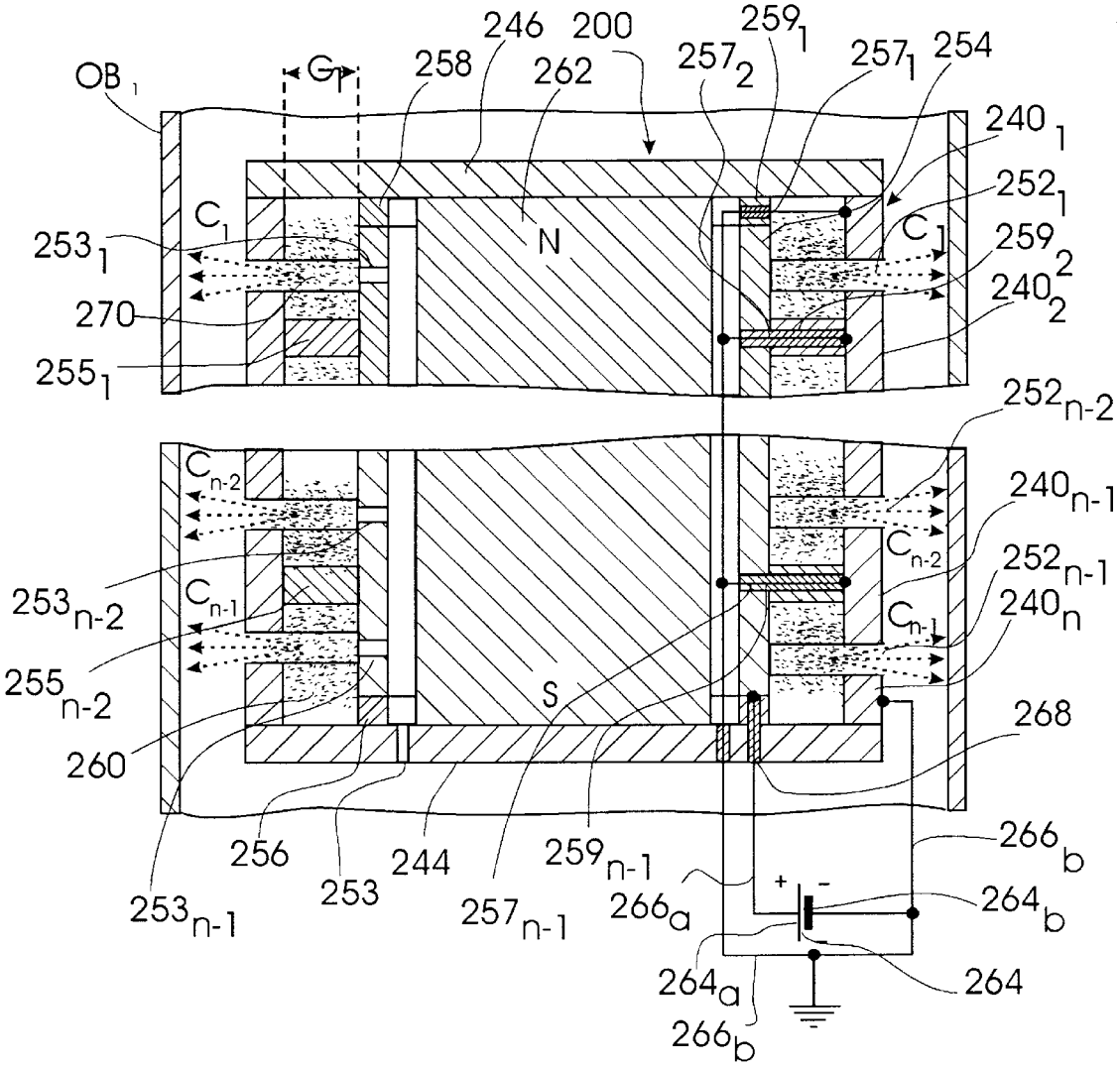
FIG. 6 is a longitudinal sectional view of an ion source of the type shown in FIG. 4 with a plurality of ion emitting slits associated with a common anode.

FIG. 6—Ion Source with Common Anode in Connection with a Plurality of Annular Ion-Emitting Slits The ion source of the type shown in FIG. 6 is similar to the one described with reference to FIGS. 4, 5, 5A and differs from it in that the ion source has a common anode operating in connection with a plurality of through annular ion-emitting slits formed on the periphery of a tubular housing. In FIG. 6 the parts of the ion beam source that correspond to similar parts of the previous embodiment are designated by the same reference numerals with an addition of 100.

FIG. 6 is a sectional view of a closed-loop ion source 200 of the invention for emission of ion beams in a radial outward direction in a plane of drift of electrons, the ion source having a common anode in connection with a plurality of ion-emitting slits.

More specifically, ion source 200 has a hollow housing 240 made of a magnetoconductive material which is used as a cathode. Similar to the embodiment of FIGS. 4, 5 and 5A, housing 240 may have an oval-shaped, cylindrical, elliptical, or any other suitable configuration.

Housing 240 has a closed flat bottom 244 and a flat top side 246 with a plurality of through closed-loop ion-emitting slit $\mathbf{252}_1, \ldots \mathbf{252}_{n-2}, \mathbf{252}_{n-1}$ formed in the side wall of housing 240 around its entire periphery. The slits lie in planes substantially perpendicular to the longitudinal axis of tubular housing 240.

Hollow housing or cathode 240 contains a similarly-shaped concentric anode 254 which is fixed inside the housing by means of appropriately-shaped bodies 256 and 258 of a dielectric material such as a ceramic. Anode 254 is spaced from the inner walls of cathode 240 at a radial distance $G_1$ required to form an ion-generating and accelerating space 260. In the direction of the longitudinal axis of housing 240, anode 254 covers the span between the first slit $\mathbf{252}_1$ and last slit $\mathbf{252}_{n-1}$ so that all ion emitting slits may cooperate with common anode 254.

A magnetic-field generation means, which in this embodiment is shown as a permanent magnet 262, is located inside anode 254 and is spaced from the inner surface of the anode.

The parts of the cathode of source 200 which form individual ion-emitting slits $\mathbf{252}_1$, . . . $\mathbf{252}_{n-2}$, $\mathbf{252}_{n-1}$, are supported by means of spacers $\mathbf{255}_1$, . . . $\mathbf{255}_{n-2}$ and are electrically interconnected by means of conductors $\mathbf{257}_1$, . . . $\mathbf{257}_{n-1}$ which pass via a high-voltage electric feed-through units $\mathbf{259}_1$ . . . $\mathbf{259}_{n-1}$.

A working gas supply holes 253, $\mathbf{253}_1$ . . . $\mathbf{253}_{n-2}$, $\mathbf{253}_{n-1}$ which deliver working medium to the area of generation of plasma are formed in bottom plate 244 and walls of common anode 254. The holes which are formed in the wall of the anode are uniformly distributed in the circumferential direction.

Anode 254 is electrically connected to a positive pole 264*a* of an electric power supply unit 264 by a conductor line 266 which passes into housing 240 via a conventional electric feedthrough 268. Respective parts $\mathbf{240}_1$ . . . $\mathbf{240}_{n-1}$, $\mathbf{240}_n$ of cathode 240 are electrically connected to a negative pole 264*b* of power supply unit 264 via aforementioned conductors $\mathbf{257}_1$ . . . $\mathbf{257}_{n-1}$.

In operation, vacuum chamber (not shown) or tubular object $OB_1$ is evacuated, and a working gas is fed into the interior of housing 240 of ion source 200 via inlet opening 253. A magnetic field is generated by permanent magnet 262 in ionization and acceleration gap 260 between anode 254 and cathode 240, whereby electrons begin to drift in a closed path within the crossed electrical and magnetic fields. In the case of the device of the invention, the ions begin to accelerate in annular space 260 between anode 254 and cathode 260 and move in the planes of the slits. As a result, the accelerated ions are emitted from annular slits $\mathbf{252}_1$, . . . $\mathbf{252}_{n-1}$, i.e., in the radial outward direction shown by arrows $C_1$ . . . $C_{n-1}$ in FIG. 6. In a plan view of the source of this embodiment(not shown), the ions are emitted in the same pattern as shown in FIGS. 5 and 5A.

A plasma 270 is formed between anode 254 and cathode 240. When the working gas is passed through ionization and acceleration gap $G_1$, radial ion beams which propagate outwardly in the direction shown by arrows $C_1$, . . . $C_{n-1}$, in FIG. 6, are formed in the area of ion-emitting slits $\mathbf{252}_1$, . . . $\mathbf{252}_{n-1}$ and in accelerating gap $G_1$ between anode 254 and cathode 240.

Ion source 200 of this embodiment is suitable for treating the entire inner surface of a stationary tubular body in one pass.

It is understood that object $OB_1$ and hence ion source 200 are located in a vacuum chamber (not shown) which may be identical to the one described in connection with the prior art. It is also understood that the object itself can be sealed and evacuated.

Figure 7:
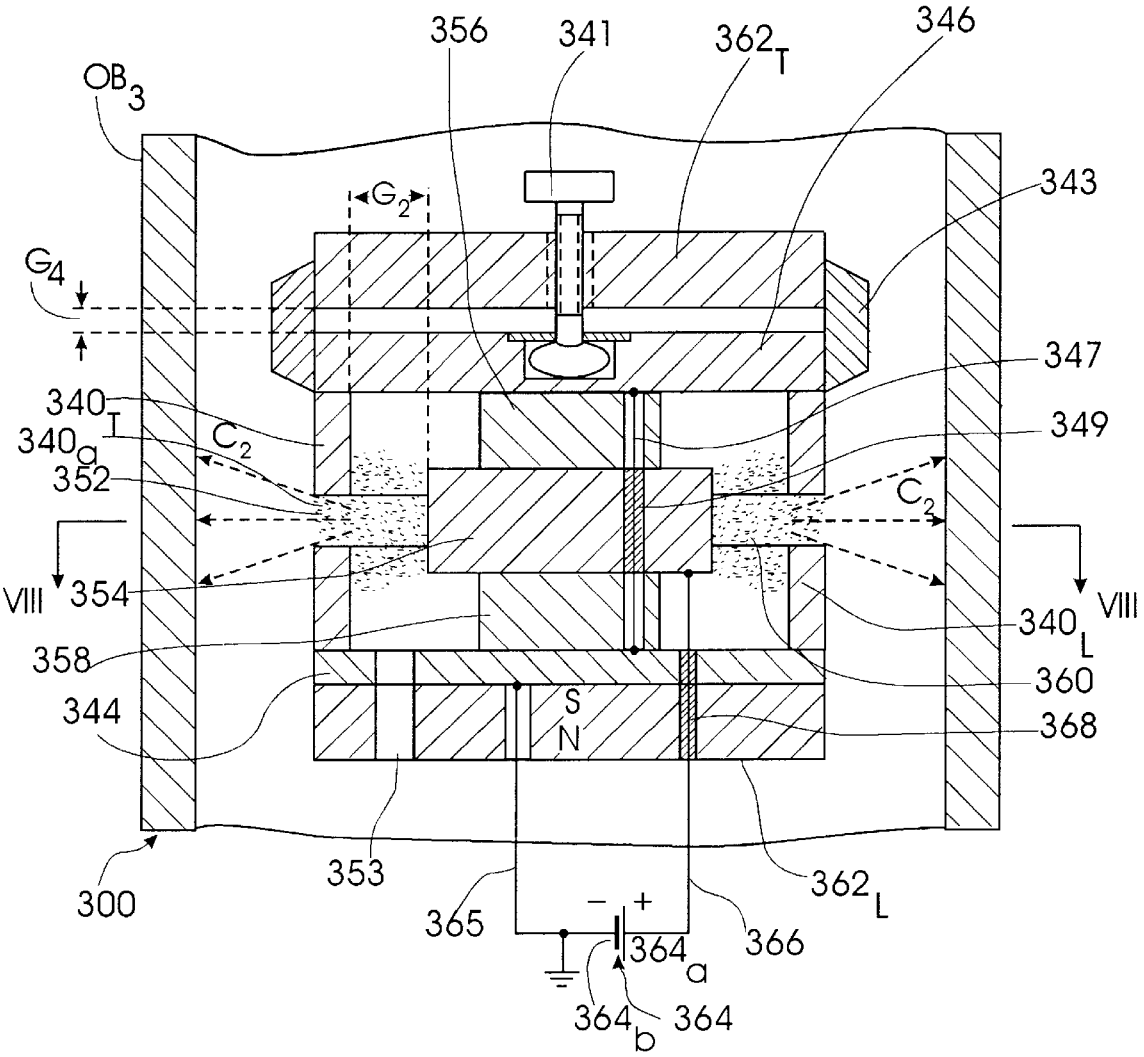
FIG. 7 is a is a longitudinal sectional view of an ion source of the type shown in FIG. 4 with the external location of magnets.
Figure 8:
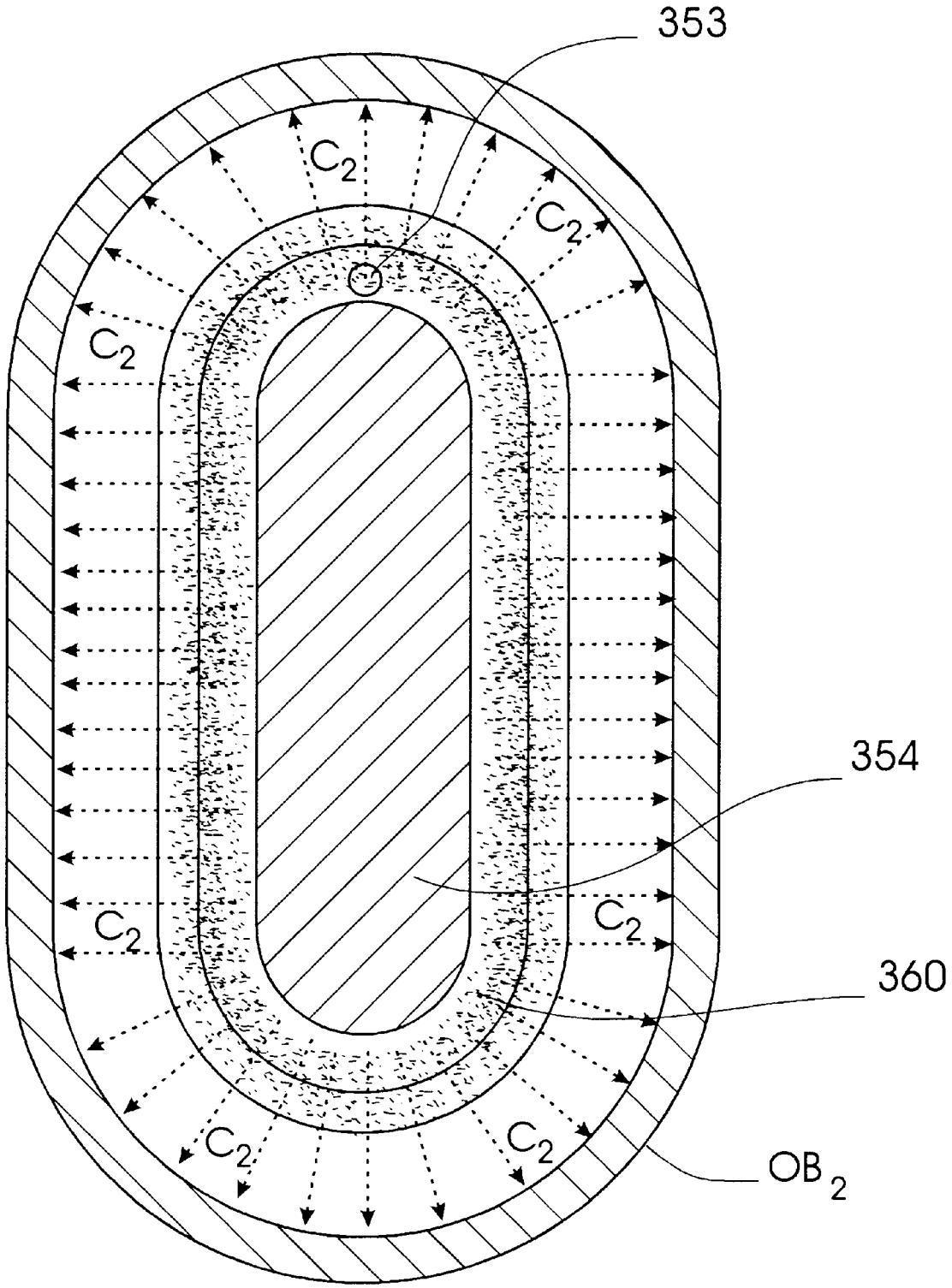
FIG. 8 is a sectional view in the direction of line VIII—VIII of FIG. 7 illustrating an oval shape of the ion beam source housing, anode, magnet, and object being treated.
Figure 8A:
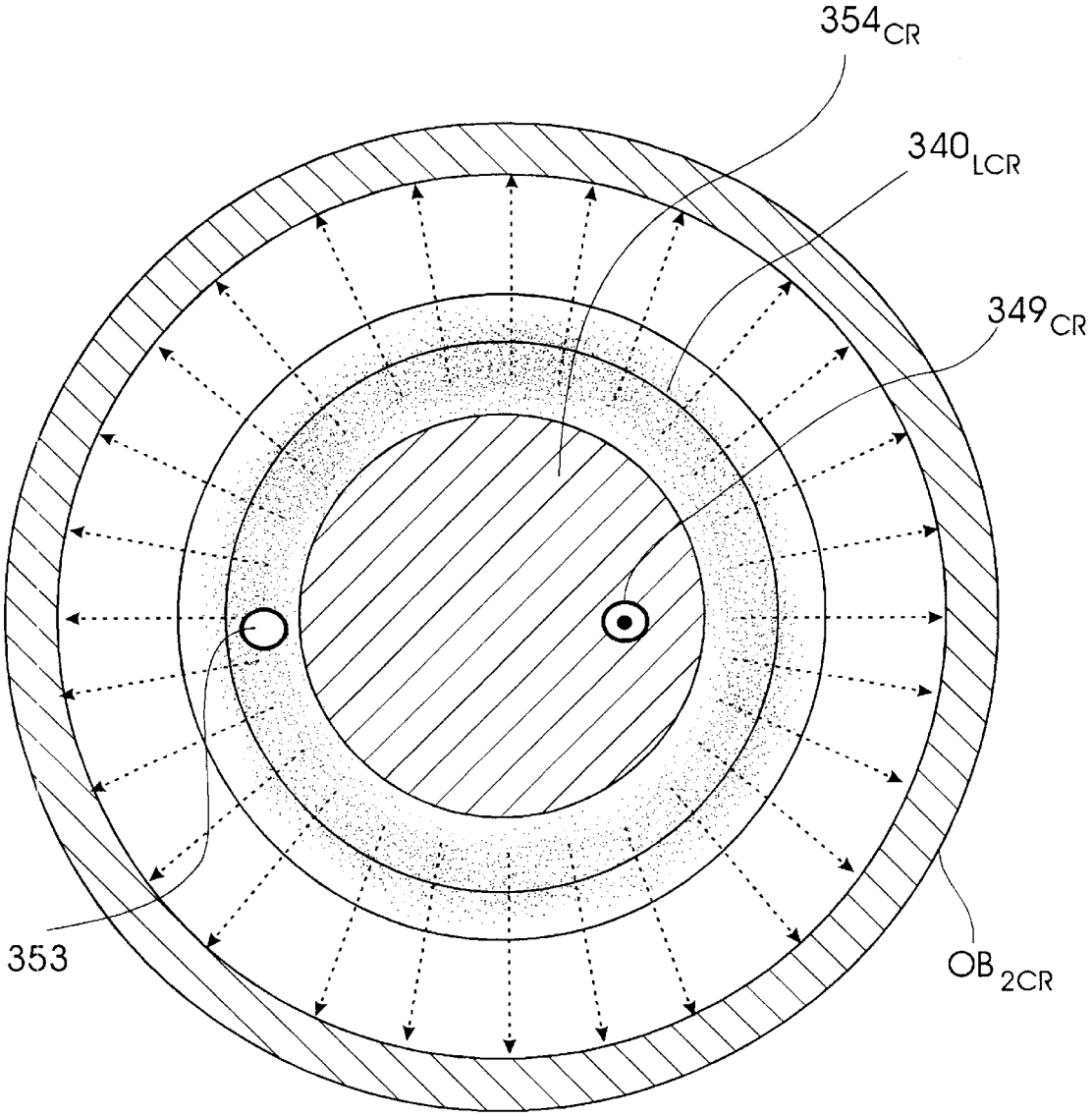
FIG. 8A is a view similar to FIG. 8 illustrating a circular cylindrical shape of the ion beam source housing, anode, magnet, and object being treated.

FIGS. 7, 8, and 8A—Ion Source with External Location of Magnet

The ion source of the type shown in FIGS. 7 and 8 is similar to the one described with reference to FIGS. 4 and 5 and differs from it in that the ion source has an external location of a magnet. In FIG. 6 the parts of the ion beam source that correspond to similar parts of the previous embodiment are designated by the same reference numerals with an addition of 200.

FIG. 7 is a longitudinal sectional view of the ion source of this embodiment, and FIG. 8 is a sectional view in the direction of line VIII—VIII of FIG. 7.

An ion source of this embodiment, which in general is designated by reference numeral 300, has a hollow housing 340 made of a magnetoconductive material which is used as a cathode. In the embodiment of FIGS. 7 and 8, housing 340 has an oval-shaped configuration which is shown only for illustrative purposes, since the housing may be cylindrical or elliptical, or may have any other suitable configuration.

FIG. 8A is a view similar to FIG. 8 illustrating an ion beam source having a circular cylindrical housing $\mathbf{340}_{CR}$, anode $\mathbf{354}_{CR}$, magnet $\mathbf{356}_{CR}$, and tubular object being treated $OB_2$. This embodiment does not need detailed explanation as all the parts are the same as in FIG. 8 with the exception that the ion source of this embodiment is intended for treating inner surfaces of cylindrical tubular objects $OB_2$. In FIG. 8A, the parts which correspond to those of FIG. 8 are designated by the same reference numerals with an addition of subscript "$_{CR}$".

Housing 340 has a closed flat bottom 344 and a flat top side 346 with a through closed-loop ion-emitting slit 340*a* formed in the wall of housing 340 around its entire periphery, approximately in the middle of the height of the housing.

A working gas supply hole 353 passes through flat bottom 344 of housing 340 and a lower magnet $\mathbf{362}_L$ for injection of a working medium into a closed space formed by housing 340 and upper and lower plates 344 and 346.

Hollow housing or cathode 340 contains a solid similarly-shaped concentric anode 354 which is fixed inside the housing by means of bodies 356 and 358 of a dielectric material, such as ceramic. Anode 354 is spaced from the inner walls of cathode 340 at a radial distance G2 required to form an ion-generating and accelerating space 360. In the direction of the height of housing 340, anode 354 is aligned with the position of closed-loop slit 340*a*.

A magnetic-field generation means is formed by an upper permanent magnet $\mathbf{362}_T$ and a lower permanent magnet $\mathbf{362}_L$, which both are located outside hollow housing 340 in a magnetoconductive relationship with this housing. More specifically, upper magnet $\mathbf{362}_T$ is placed onto top side 346 of the housing, and lower magnet $\mathbf{362}_L$ is placed onto flat bottom side 344 of housing 340.

Anode 354 is electrically connected to a positive pole 364*a* of an electric power supply unit 364 by a conductor line 366 which passes into housing 340 via a conventional electric feedthrough 368. Cathode 340 is electrically connected to a negative pole 364*b* of power supply unit 364 via a conductor 365.

As shown in FIG. 7, upper and lower sides $\mathbf{340}_T$ and $\mathbf{340}_L$ of cathode 340, which form ion-emitting slit 340*a*, are grounded via conductor 347 which electrically connects these parts with a negative pole 364*b* of a power source 364 and passes via an electric feedthrough 349, in order to isolate conductor 347 from anode 354 which is under positive voltage.

A position of one of the magnets, e.g., of upper magnet $\mathbf{362}_T$ may be adjusted with respect to upper part $\mathbf{340}_T$ of cathode 340, e.g., by a screw 341, so that magnet $\mathbf{362}_T$ can be shifted up or down in a guide portion 343 of upper part $\mathbf{340}_T$ of the cathode. This allows adjustment of magnetic resistance in the magnetoconductive circuit formed by magnets $\mathbf{362}_T$, $\mathbf{362}_L$, upper and lower parts of cathode $\mathbf{340}_T$ and $\mathbf{340}_L$, and ion-emitting slit 340*a*. In other words, a gap $G_4$ shown in FIG. 7 can be adjusted.

It is understood that one adjustable magnet is shown only as an example and that the same adjustment can be performed with the lower magnet or with both simultaneously or individually.

In operation, vacuum chamber (not shown) or object $OB_2$ is evacuated, and a working gas is fed into the interior of housing 340 of ion source 300 via inlet opening 353. A magnetic field is generated by permanent magnets $\mathbf{362}_T$ and $\mathbf{362}_L$ in ionization and acceleration gap 360 (FIG. 7) between anode 354 and cathode 340, whereby electrons begin to drift in a closed path within the crossed electrical and magnetic fields. In the case of the device of the invention, the electrons begin to drift in annular space 360 between anode 354 and two parts of the cathode 340, whereas the ions are accelerated in space 360 and are emitted in the radial outward direction shown by arrow $C_2$ in FIG. 7 and FIG. 8 (see more detailed explanation of the phenomenon given above on page 7).

A plasma 370 is formed between anode 354 and cathode 340. When the working gas is passed through ionization and acceleration space 360, the ion beam, which propagates outwardly in the direction shown by an arrows $C_2$, is formed in the area of ion-emitting slit 352 and in accelerating space 360 between anode 354 and cathode 340.

Ion source 300 of this embodiment is suitable for treating inner surfaces of tubular bodies. In this embodiment a tubular body $OB_2$ was shown having an oval-shaped and a circular-shaped configurations to which the shape of ion source 300 was matched. An advantage of this embodiment is easier access to permanent magnets $\mathbf{362}_T$ and $\mathbf{362}_L$ whereby the externally located magnets can be easily repaired or replaced.

It is understood that object $OB_4$ and hence ion source 300 are located in a vacuum chamber (not shown) which may be identical to the one described in connection with the prior art. It is also understood that the object itself can be sealed and evacuated.

Figure 9:
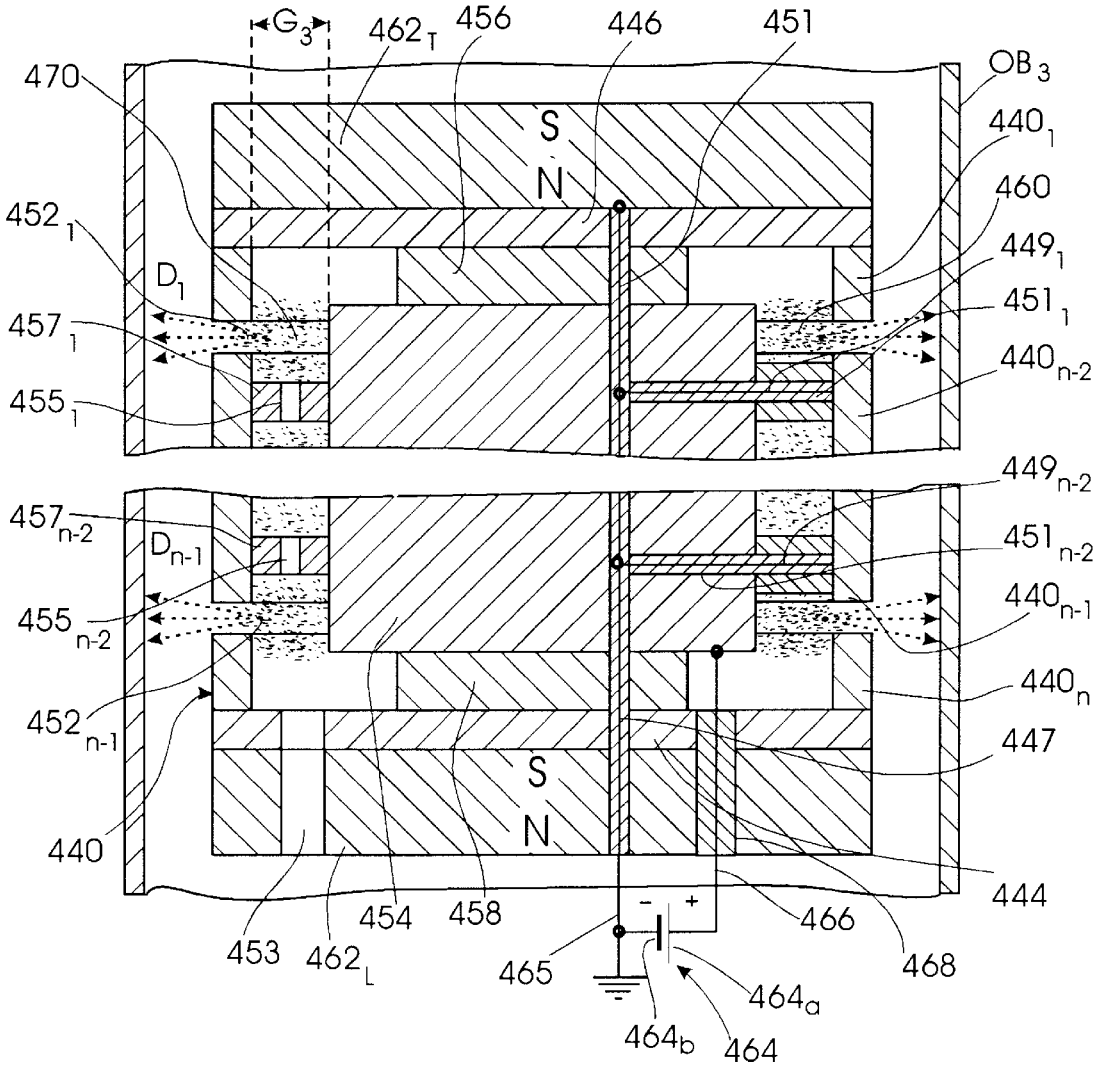
FIG. 9 is a view similar to the one of FIG. 6 with external location of magnets.

FIG. 9—Ion Source with Common Anode for a Plurality of Ion-Emitting Slits with External Location of Magnets An ion source of this embodiment, which in general is designated by reference numeral 400, combines all features of the ion source of the embodiment of FIG. 6 with those of the embodiment of FIG. 7. Therefore those parts of ion source 400 which are identical to similar parts of the aforementioned previous embodiments will be designated by the same reference numerals as in FIGS. 6 but with an addition of 200.

More specifically, ion source 400 has a hollow housing 440 made of a magnetoconductive material which is used as a cathode. Similar to the embodiment of FIGS. 4 and 5, housing 440 may have an oval-shaped, cylindrical, elliptical, or any other suitable configuration.

Housing 440 has a closed flat bottom 444 and a flat top side 446 with a plurality of through closed-loop ion-emitting slit $\mathbf{452}_1$, . . . $\mathbf{452}_{n-2}$, $\mathbf{452}_{n-1}$ formed in the side wall of housing 440 around its entire periphery. The slits lie in planes substantially perpendicular to the longitudinal axis of tubular housing 440.

A working gas supply hole 453 is formed in bottom plate 444 of housing 440, and gas passages $\mathbf{455}_1$, . . . $\mathbf{455}_{n-1}$ are formed in spacers $\mathbf{457}_1$ . . . $\mathbf{457}_{n-2}$ which supports parts $\mathbf{440}_1$ . . . $\mathbf{440}_n$ of cathode 440 which are separated by respective ion-emitting slits $\mathbf{452}_1$ . . . $\mathbf{452}_{n-2}$, $\mathbf{452}_{n-1}$.

Hollow housing or cathode 440 contains a similarly-shaped solid concentric anode 454 which is fixed inside the housing by means of bodies 456 and 458 of a dielectric material, such as ceramic. Anode 454 is spaced from the inner walls of cathode 440 at a radial distance $G_3$ required to form an ion-generating and accelerating space 460. In the direction of the longitudinal axis of housing 440, anode 454 covers the span between the first slit $\mathbf{452}_1$ and last slit $\mathbf{452}_{n-1}$ so that all ion emitting slits may cooperate with common anode 454.

A magnetic-field generation means is formed by an upper permanent magnet $\mathbf{462}_T$ and a lower permanent magnet $\mathbf{462}_L$, which both are located outside hollow housing 440 in a magnetoconductive relationship with this housing. More specifically, upper magnet $\mathbf{462}_T$ is placed onto top side 446 of the housing, and lower magnet $\mathbf{462}_L$ is placed onto flat bottom side 444 of housing 440.

Anode 454 is electrically connected to a positive pole 464*a* of an electric power supply unit 464 by a conductor line 466 which passes into housing 440 via a conventional electric feedthrough 468. Cathode 440 is electrically connected to a negative pole $\mathbf{464}_b$ of power supply unit 464 via a conductor 465.

As shown in FIG. 9, parts $\mathbf{440}_1$, 446, $\mathbf{440}_2$, . . . $\mathbf{440}_{n-1}$, $\mathbf{440}_n$, 444 of cathode 440, which form respective ion-emitting slits $\mathbf{440}_1$ . . . $\mathbf{440}_{n-1}$, are grounded via conductors 447, $\mathbf{449}_1$ . . . $\mathbf{449}_{n-2}$ which electrically connect these parts with a negative pole $\mathbf{464}_b$ of a power source 464 of and pass via high-voltage electric feedthrough units 451, $\mathbf{451}_1$, . . . $\mathbf{451}_{n-2}$, in order to isolate the conductors from anode 454 which is under positive voltage.

A position of one of the magnets or of both magnets may be adjustable as described in the previous embodiment of the invention.

In operation, vacuum chamber (not shown) or tubular object $OB_3$ is evacuated, and a working gas is fed into the interior of housing 440 of ion source 400 via inlet opening 453 and gas passages $\mathbf{455}_1$ . . . $\mathbf{455}_{n-2}$. A magnetic field is generated by permanent magnets $\mathbf{462}_T$ and $\mathbf{462}_L$ in ionization and acceleration gap 460 between anode 454 and cathode 440, whereby electrons begin to drift in a closed path within the crossed electrical and magnetic fields. In the case of the device of the invention, the electrons begin to drift in annular space 460 between anode 454 and cathode 460, and ions are emitted from annular slits $\mathbf{452}_1$, . . . $\mathbf{452}_{n-1}$, i.e., in the radial outward direction shown by arrows $D_1$, . . . $D_{n-1}$ in FIG. 9. In a plan view of the source of this embodiment(not shown), the ions are emitted in the same pattern as shown in FIG. 5.

A plasma 470 is formed between anode 454 and cathode 440. When the working gas is passed through ionization and acceleration space 460, ion beams, which propagate outwardly in the direction shown by arrows $D_1$, . . . $D_{n-1}$ in FIG. 9, are formed in the area of ion-emitting slits $\mathbf{452}_1$, . . . $\mathbf{452}_{n-1}$ and in accelerating space 460 between anode 454 and cathode 440.

Ion source 400 of this embodiment is suitable for treating the entire inner surface of a stationary tubular body in one pass. This source also incorporates the advantages of an external location of the magnets which are always accessible to repair and replacement.

It is understood that object $OB_3$ and hence ion source 400 are located in a vacuum chamber (not shown) which may be identical to the one described in connection with the prior art. It is also understood that the object itself can be sealed and evacuated.

Figure 10:
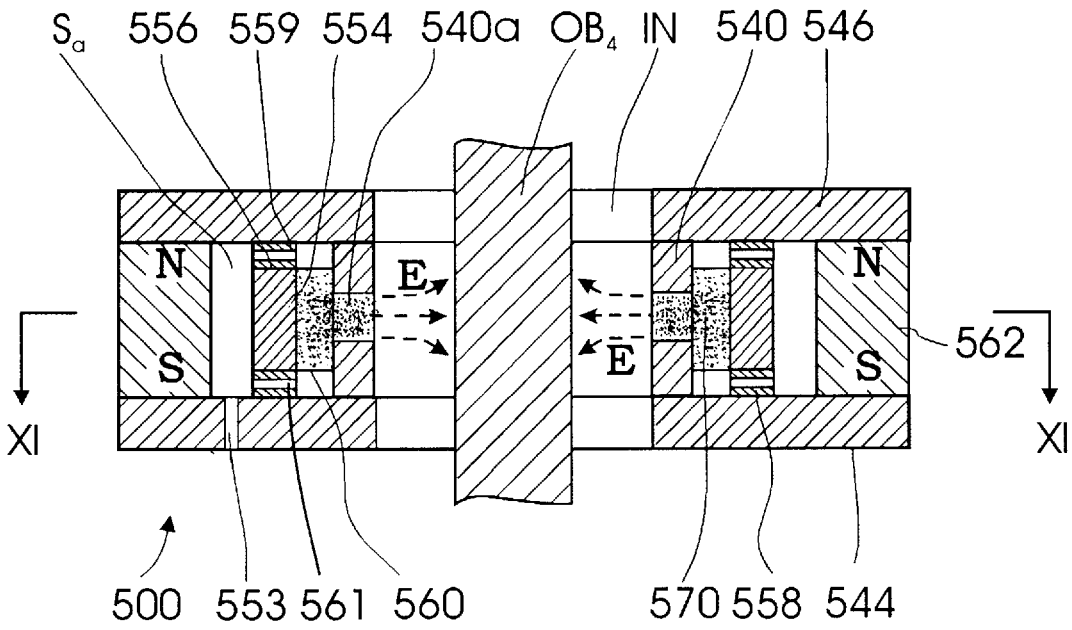
FIG. 10 is a sectional view of a closed-loop ion source of the invention for emission of ion beams in a radial inward direction in a plane of drift of electrons.
Figure 11A:
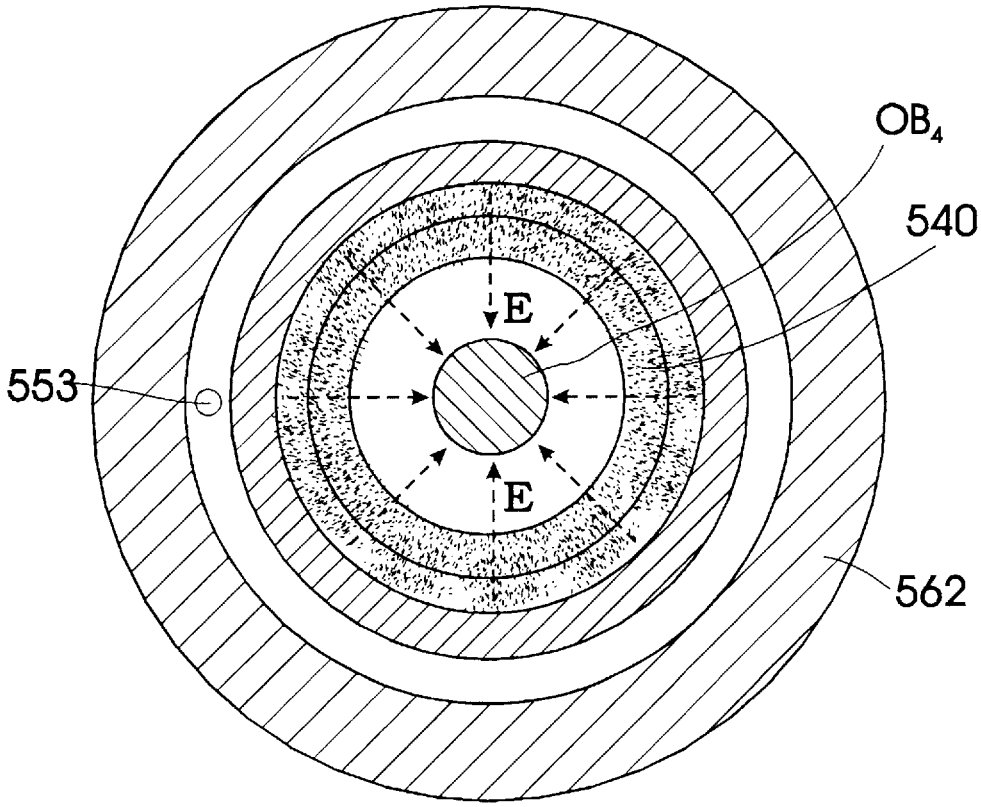
FIG. 11A is a sectional view of the ion source of FIG. 10 in the direction of line XI—XI of FIG. 10 illustrating a circular cylindrical shape of the ion beam source housing, anode, magnet, and object being treated.
Figure 11:
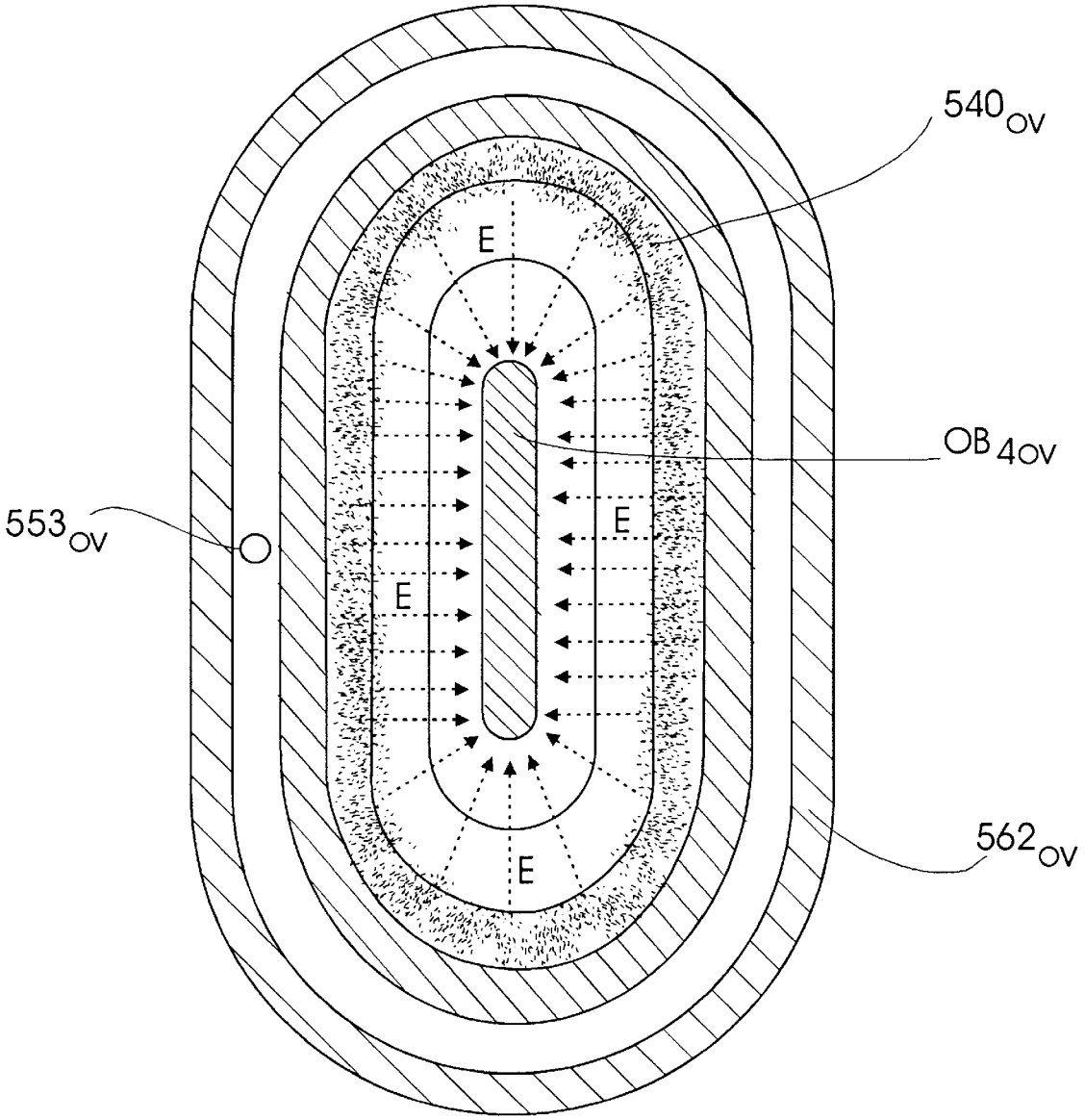
FIG. 11 is a sectional view of the ion source of FIG. 10 in the direction of line XI—XI of FIG. 10 illustrating an oval shape of the ion beam source housing, anode, magnet, and object being treated.
Figure 12:
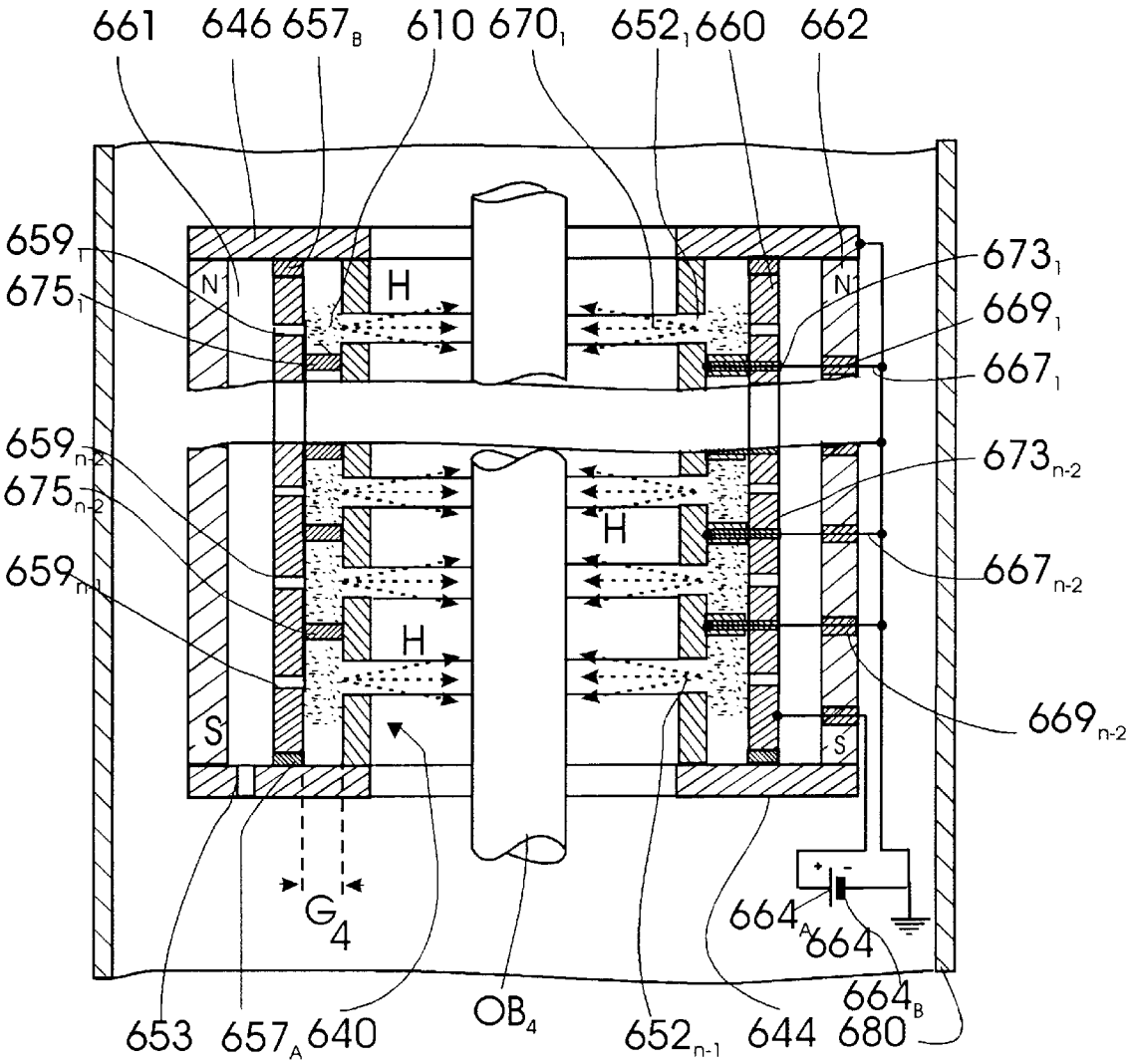
FIG. 12 is a sectional view of an ion source with a plurality of ion emitting slit, the source having externally located magnet and emitting ion beams in the radially inward direction.

FIGS. 10, 11, and 12—Closed-Loop Ion Sources for Emission of Ion Beams in a Radial Inward Direction in a Plane of Drift of Electrons FIG. 10 is a sectional view of a closed-loop ion source of the invention for simultaneously treating the entire outer surface of tubular objects. The ion beams are emitted in a radial inward direction in a plane of the ion-emitting slit.

FIG. 11 is a sectional view of the ion source of FIG. 10 in the direction of line XI—XI.

An ion source of this embodiment, which in general is designated by reference numeral 500, has a tubular housing 540 made of a magnetoconductive material which is used as a cathode. In the embodiment of FIGS. 10 and 11, housing 540 has a circular cross-sectional configuration which is shown only for illustrative purposes, since the housing may be oval or elliptical, or may have any other suitable configuration. In the illustrated embodiment, ion source 500 is intended for treating outer surfaces of longitudinal objects over their entire periphery while such objects are passed through the interior IN of tubular housing 540. Object $OB_4$ may be a rod, tube, or a tape moveable through the interior IN. For example, object $OB_4$ may be a tape which passes through the interior IN of the ion source as it is unwound from a feed reel and wound onto a takeup reel (not shown) with the deposition of a coating layer onto the tape surface.

Housing 540 has through closed-loop ion-emitting slit 540*a* formed in the wall of housing 540 around its entire periphery, approximately in the middle of the height of the housing. Housing 540 has a lower flange 544 and an upper flange 546. In a top view, which is not shown, flanges 544 and 546 may have configurations concentric with respect to housing or cathode 540. Located between peripheral edges of flanges 544 and 546 is a tubular magnet 562. As shown in FIG. 11, which is a cross-sectional view along line XI—XI of FIG. 10, magnet 562 has configuration concentric with respect to housing 540, so that a closed annular space Sa is formed between the inner surface of tubular magnet 562, the outer surface of anode 554, and both flanges 544 and 546.

In order to prevent electrical breakdown between magnet 562 and anode 560, space Sa should be sufficient to exclude this phenomenon. Alternatively, shielding sleeve (not shown) should be place in space Sa.

A working gas supply hole 553 is formed in the lower flange 544 for the supply of a working medium into aforementioned space S.

Tubular housing or cathode 540 contains a similarly-shaped concentric anode 554 which is fixed inside the housing by means of circular-shaped bodies 556 and 558 of a dielectric material, such as ceramic. A plurality of radial channels 559 and 561 are formed in bodies 556 and 558 for the supply of the working medium to an ion-generating and accelerating space 560 formed between cathode 540 and anode 554. In the direction of the height of housing 540, anode 554 is aligned with the position of closed-loop slit 540*a*.

Anode 554 is electrically connected to a positive pole of an electric power supply unit by a conductor line which passes into housing 540 via a high-voltage electric feedthrough. Cathode 540 is electrically connected to a negative pole of power supply unit (the source of electric power supply, conductors, and feedthrough are not shown as they are identical to those described in the previous embodiments).

Ion source 500 is located in a vacuum chamber which is not shown in FIG. 11 and which may have a cross-sectional configuration concentric with respect to housing 540, anode 554, and magnet 562.

In operation, vacuum chamber is evacuated, and a working gas is fed into space Sa of ion source 500 via inlet opening 553. A magnetic field is generated by permanent magnet 562 in ionization and acceleration gap $\mathbf{540}_a$ (FIG. 10. A permanent electric field exists between anode 554 and cathode 540. Electrons begin to drift in a closed path within the crossed electrical and magnetic fields. In the case of the device of the invention, the electrons begin to drift in annular space, i.e., ion-emitting slit $\mathbf{540}_a$ between the upper and lower parts of cathode 540. The ions, generated in space 560 and accelerated by the electric field are emitted from slit 540*a* in the radial inward direction shown by arrows E in FIG. 10 and by a plurality of arrows E in FIG. 11.

A plasma 570 is formed between anode 554 and cathode 540. When the working gas is passed through ionization and acceleration gap 560, ion beams which propagate inwardly in the direction shown by an arrows E, are formed in the area of ion-emitting slit 540*a* and in accelerating gap 560 between anode 554 and cathode 540.

Ion source 500 of this embodiment is suitable for treating outer surfaces of tubular bodies. In this embodiment object $OB_4$ is shown in the form of a round rod which the shape of ion source 500 was matched. It is understood, however, that object $OB_4$ may comprise an oval tube, and source 500 also may have an oval shape.

FIG. 11A is a view similar to FIG. 11 illustrating an ion beam source having an oval housing, anode, magnet, and object being treated. This embodiment does not need detailed explanation as all the parts are the same as in FIG. 11 with the exception that the ion source of this embodiment is intended for treating outer surfaces of oval tubular objects. In FIG. 11A, the parts which correspond to those of FIG. 11 are designated by the same reference numerals with an addition of subscript $_{ov}$.

FIG. 12 is a sectional view of a closed-loop ion source made in accordance with another embodiment of the invention. The ion source of this embodiment is similar to the one described with reference to FIGS. 10 and 11. However, it differs from the previous embodiment by employing a common anode and a plurality of annular slits for emitting a plurality of radially inwardly directed beams in the plane of drift of electrons.

An ion source of this embodiment, which in general is designated by reference numeral 600, has a tubular housing 640 made of a magnetoconductive material which is used as a cathode. In the embodiment of FIG. 12, housing 640 has a tubular configuration, e.g., similar to the one shown in FIG. 11.

Housing 640 has a plurality of through closed-loop ion-emitting slits $\mathbf{652}_1 \ldots \mathbf{652}_{n-1}$ formed in the side wall $\mathbf{640}_a$ of housing 640 around its entire periphery and spaced from each other in the direction of the source height.

Housing 640 has a lower flange 644 and an upper flange 646. In a top view, which is not shown, flanges 644 and 646 may have configurations concentric with respect to housing or cathode 640. Located between peripheral edges of flanges 644 and 646 is a tubular magnet 662. Magnet 662 has configuration concentric with respect to housing 640, so that a closed annular space 661 is formed between the inner surface of tubular magnet 662, the outer surface of anode 660, and both flanges 644 and 646. In order to prevent electrical breakdown between magnet 662 and anode 660, space 661 should be sufficient to exclude this phenomenon. Alternatively, shielding sleeve (not shown) should be place in space 661.

A working gas supply hole 653 is formed in the lower flange 644 for the supply of a working medium into space 661 between magnet 662 and a common anode 660 via radial channels $\mathbf{659}_1 \ldots \mathbf{659}_{n-1}$ in anode 660. In the embodiment of FIG. 12, anode 660 has a tubular form and is located outside cathode 640 concentrically thereto.

Anode holders $\mathbf{657}_a$ and $\mathbf{657}_b$ are made of a dielectric material, such as ceramic. Anode 660 is spaced from the outer walls of cathode 640 at a radial distance $G_4$ required to form an ion-generating and accelerating space 610. In the direction of the height of housing 640, anode 660 spans all ion-emitting slits $\mathbf{652}_1 \ldots \mathbf{652}_{n-1}$ of the cathode.

Anode 660 is electrically connected to a positive pole $\mathbf{664}_a$ of an electric power supply unit 664 by a conductor line 666 which passes into housing 640 via a conventional electric feedthrough 668. Cathode 640 is electrically connected to a negative pole $\mathbf{664}_b$ of power supply unit 664 by a conductor 667. Branches $667_1 \ldots 667_{n-2}$ pass to electrically separated parts $640_1 \ldots 640_{n-1}$ of the cathode via feedthrough units $669_1 \ldots 669_{n-2}$. Negative pole $^{664}$b of the power source is also connected to the flanges. High-voltage feedthrough units $673_1 \ldots 673_{n-2}$ pass via respective cathode holders $675_1 \ldots 675_{n-2}$ and the body of anode 660.

Ion source 600 is located in a vacuum chamber 680 which may have a cross-sectional configuration concentric with respect to housing 640, anode 654, and magnet 662. Details of vacuum chamber 680, such as seals, an observation window and connection to a vacuum pump are not shown.

In operation, vacuum chamber 680 is evacuated, and a working gas is fed into space 661 of ion source 600 via inlet opening 653 and then into ion-generating and accelerating space 610 via passages $659_1, \ldots 659_{n-1}$. A magnetic field is generated by permanent magnet 662 in ion-emitting slit 652. Electrons begin to drift in a closed path within the crossed electrical and magnetic fields. Similar to the processes described with reference to the previous embodiments, ions are generated, accelerated, and emitted in the radial inward direction shown by arrows H in FIG. 12.

Ion beams $670_1 \ldots 670_{n-1}$ are formed between anode 654 and cathode 640. When the working gas is passed through ionization and acceleration space 610, ion beams, which propagate inwardly in the direction shown by arrow H, are formed in the area of ion-emitting slits $652_1, \ldots 652_{n-1}$ and in accelerating space 610 between anode 660 and cathode 640.

Ion source 600 of this embodiment is suitable for treating simultaneously the entire outer surface of a stationary tubular body $OB_4$ placed into the interior of the hollow cathode. Furthermore, external location of the permanent magnet facilitates adjustment of the magnetic field, as well as repair and replacement of the magnet.

Figure 13:
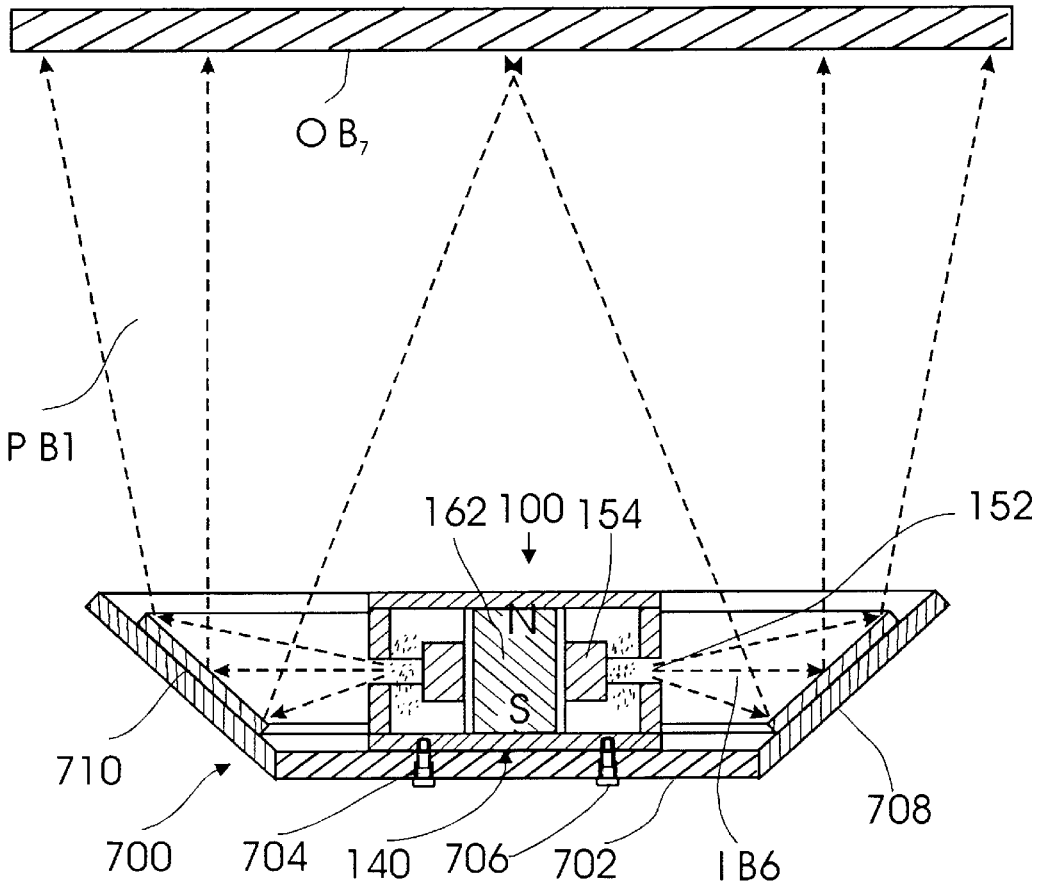
FIG. 13 is a side view of a sputtering system which consists of an ion-beam source of the present invention in combination with a stationary target holder.

FIGS. 13 through, 14,—A Single-Slit Ion Source with Ion Beam Emitted in the Direction of the Drift of Electrons with Target Holder Mechanism The principle of emission of an ion beam in the direction that coincides with the direction of the electron drift, which was described above, opens new possibilities for managing ion beams. These principles are unattainable with conventional ion beams which are perpendicular to the electron drift direction. In this connection, FIG. 13 illustrates a sputtering system which consists of any ion-beam source of the invention, e.g., ion-beam 100, with a target holder 700.

A housing or cathode 140 of an ion source 100, which can be an ion source, e.g., of the type shown in FIGS. 4 and 5, rigidly supports a target holder 700. The latter is made in the form of a plate 702 attached to housing 140, e.g., by bolts 704, 706, with a funnel-shaped peripheral portion 708 which has an upwardly directed larger diameter portion. The inner taper surface of target holder 700 supports a target 710 which has a shape of a truncated cone. The target is attached to peripheral portion 708 of holder 700, e.g., by gluing or by bolts (not shown), and is made of a material, such as cobalt, which has to be deposited onto an object $OB_7$ by sputtering.

Since ion beam $IB_6$ is emitted from a closed-loop emitting slit 152 of ion source 100 in a radial outward direction, continuously over the entire periphery of the ion source, and since the plane of target 710 is inclined to the direction of incident beam $IB_6$ (the angle of attack of the ion beam should be different from 90°), the beam sputters particles of the target, in accordance with conventional sputtering technique, and deposits them onto the surface of object $OB_7$ in the form of a converging or diverging beam of sputtered particles. The convergence or divergence of the sputtering beam depends on the taper angle of the target and the position of the object with respect to the ion source.

As shown in FIG. 13, sputtering beam PB1 covers the entire surface of object $OB_7$ so that this surface can be coated with a thin uniform layer of the target material.

Figure 14:
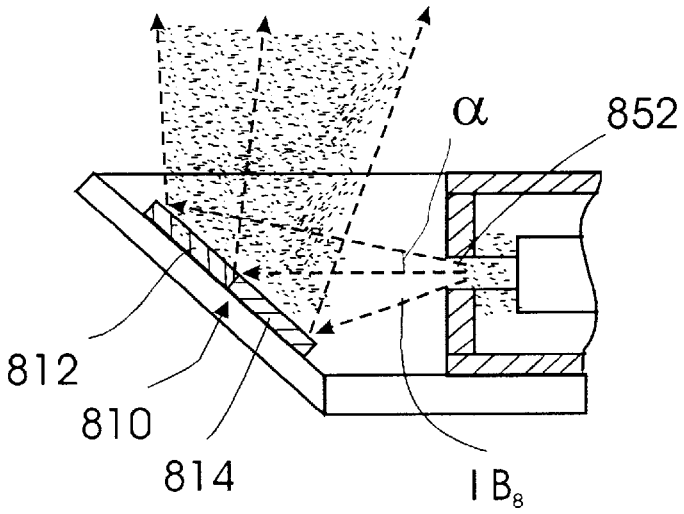
FIG. 14 is a fragmental side view of target holder of a sputtering apparatus of FIG. 13 for multiple-component sputtering.

FIG. 14 is a schematic side view of a sputtering apparatus of another embodiment. The apparatus has a target holder that provides multiple-component sputtering with a beam $IB_8$. In this embodiment, a target 810 consists of two portions made of two different materials, e.g., a portion 812 made of Co and a portion 814 made of Ni. Both portions 812 and 814 are bombarded with the same ion beam $IB_8$ emitted radially outwardly from an ion-emitting slit 852 of the ion source (not shown but assumed to be of the same type as the one described above in connection with previous embodiments of the present invention).

Beam $IB_8$ will sputter Co particles from part 812 and Ni particles from part 814. In a certain space angle $\alpha$, the Ni and Co particles will mix with each other in the central part of the beam, so that a selected surface area of the object can be coated with a multiple-component film.

If necessary, uniformity of mixing and broadening of the area covered with a multiple-component deposition film can be achieved by swinging the targets with respect to the incident beam. Such an embodiment is shown in FIGS. 15 and 16, wherein FIG. 15 is a schematic side view of the sputtering apparatus with pivotable target holders, and FIG. 16 is a top view of the apparatus of FIG. 15.

Figure 15:
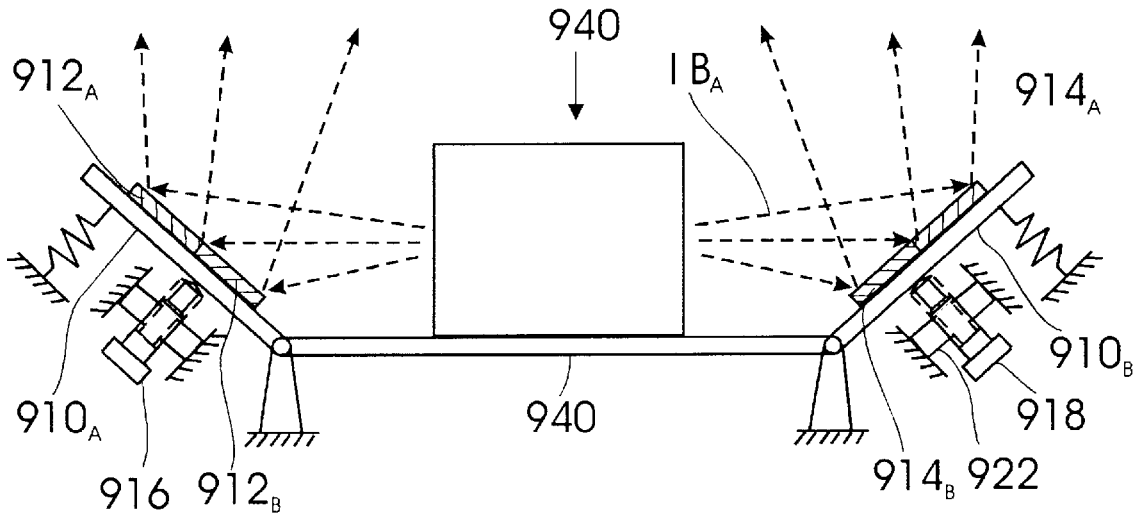
FIG. 15 is a schematic side view of a sputtering apparatus with pivotable target holders.
Figure 16:
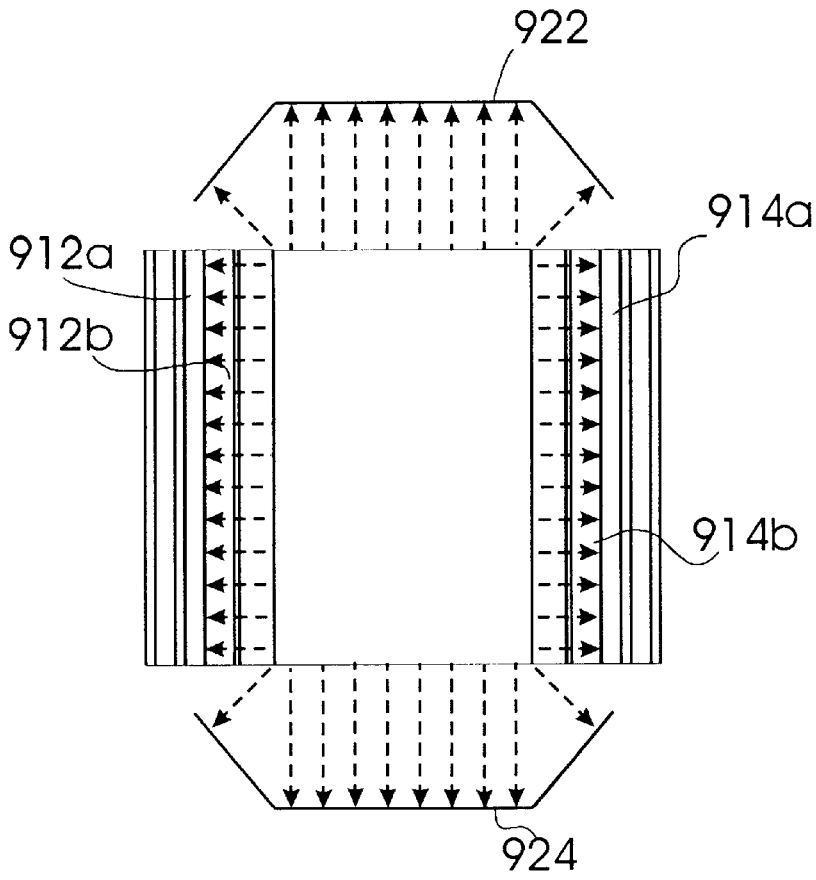
FIG. 16 is a top view of the apparatus of FIG. 15.

The apparatus of FIGS. 15 and 16 comprises an ion source 900 of the present invention which has an elongated shape (FIG. 16) with a pair of target holders 910*a*, 910*b* that hold multiple-component targets 912*a*, 912*b* and 914*a*, 914*b* arranged on both long sides of the source. This device is similar to the one shown in FIG. 14 and differs in that target holders 910*a* and 910*b* are pivotally attached to a stationary part (not shown), e.g., to housing 940 of the ion source. Holders 910*a* and 910*b* are constantly urged to the ends of adjusting bolts 916 and 918 which are screwed into stationary nuts 920 and 922 so that target holders 910*a* and 910*b* can be turned by screwing bolt 916 and 918 in and out of respective nuts 920 and 922 so that angle of the ion beam $IB_9$ emitted from ion source 900 with respect to the surface of targets 912*a*, 912*b* and 914*a*, 914*b* can be adjusted.

Reference numerals 922 and 924 designate protective shields which prevent sputtering in undesired directions.

Thus the mode of sputtering and the composition of the deposited layer can be adjusted by periodically changing the angle of attack of beam $IB_9$ on the surface of the composite target.

Figure 17:
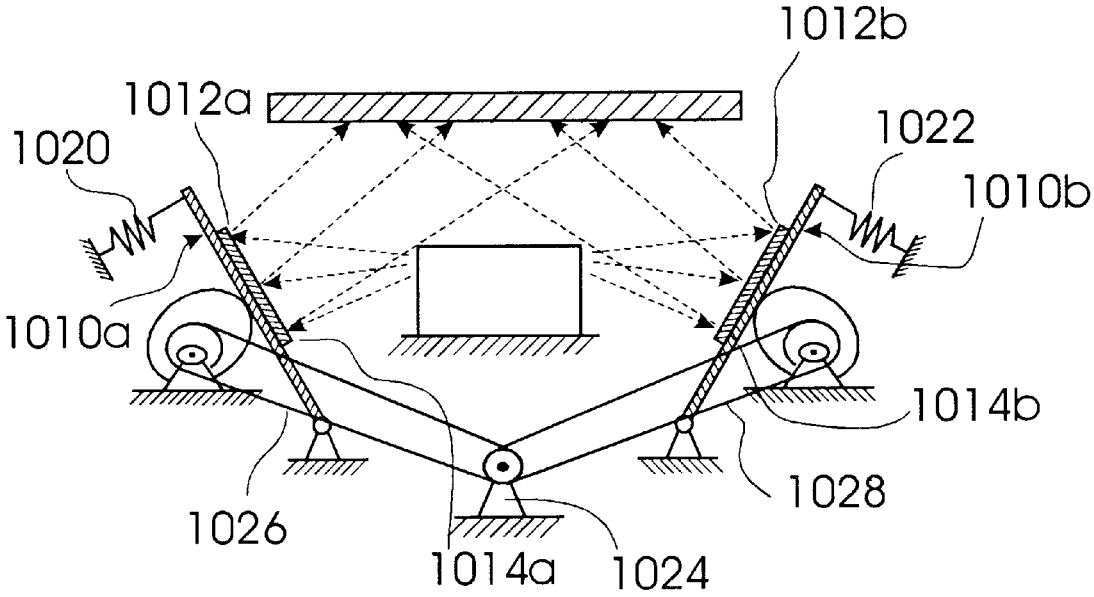
FIG. 17 shows an embodiment of the invention with constantly swinging composite target holders.

FIG. 17 shows another embodiment of the invention in which uniformity of the composite deposition and the mode of sputtering can be adjusted by constantly swinging composite target holders with respect to incident beam $IB_{10}$. In this embodiment, uniformity of composite deposition and the mode of sputtering can be adjusted by constantly swinging composite-target holders with respect to incident beam $IB_{10}$. In this embodiment, pivotally supported target holders 1010*a* and 1010*b* supports multiple-component targets 1012*a*, 1014*a*, and 1012*b*, 1014*b*, e.g., of Co and Ni, respectively. The target holders perform swinging motions under the effect of eccentric cams 1016 and 1018 which are in contact with rear sides of target holders 1010*a* and 1010*b* under the effect of springs 1020 and 1022. The cams are rotated from a motor 1024 via a belt transmissions 1026 and 1028.

The angle of attack of beam $IB_{10}$ with respect to the surfaces of targets 1012*a*, 1014*a*, and 1012*b*, 1014*b* is constantly changed so that the beam scans the surface of the targets. As a result, the composition of sputtered beam $PB_2$ is periodically changed. The mode of sputtering and the composition of the coating can be adjusted by periodically varying the speed of the motor.

Figure 18:
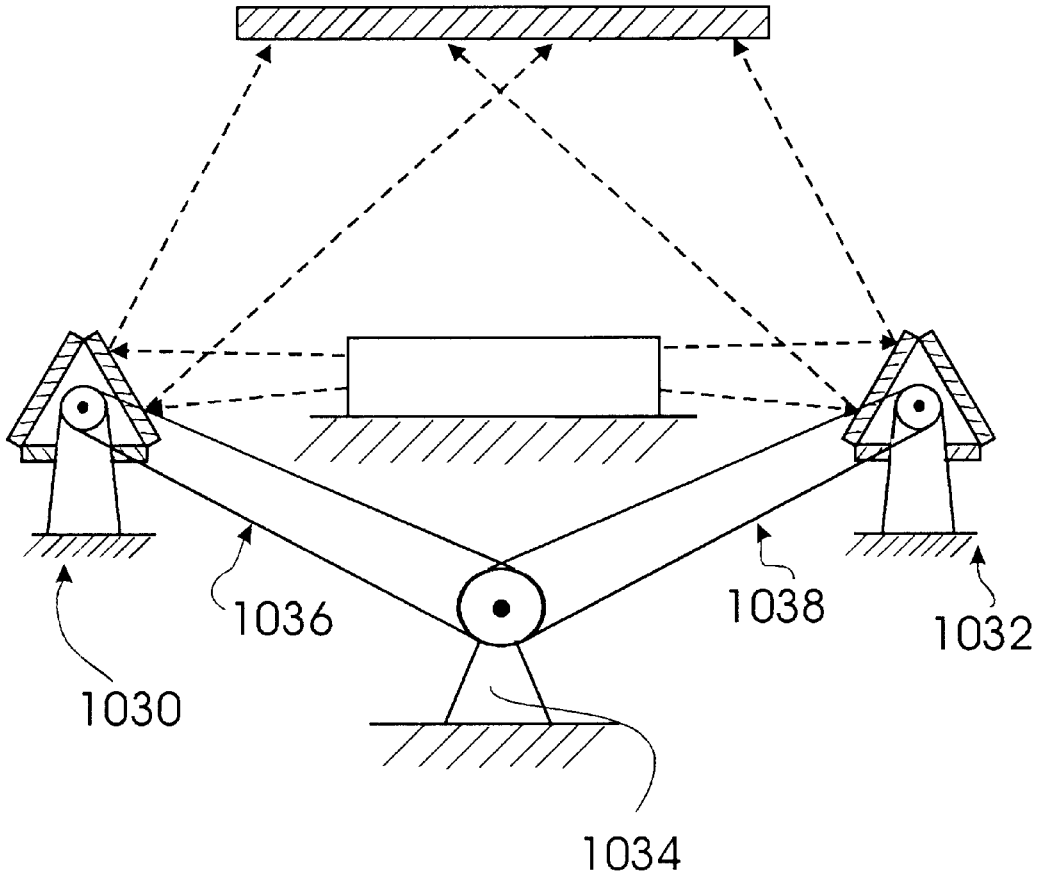
FIG. 18 is a view similar to FIG. 17 with target holders in the form of polygonal bodies.

An embodiment shown in FIG. 18 is similar to that of FIG. 17 and differs in that the target holders which hold targets are made rotatable, e.g., in the form of polygonal bodies 1030 and 1032. Facets 1030*a*, 1030*b*, 1030*c* and 1032*a*, 1032*b*, 1032*c* of target holders 1030 and 1032 supports targets (not shown) of different materials, e.g., Co, Ni, W. Holders 1030 and 1032 are rotated, e.g., by a motor 1034 via transmission belts 1036 and 1038.

Figure 19:
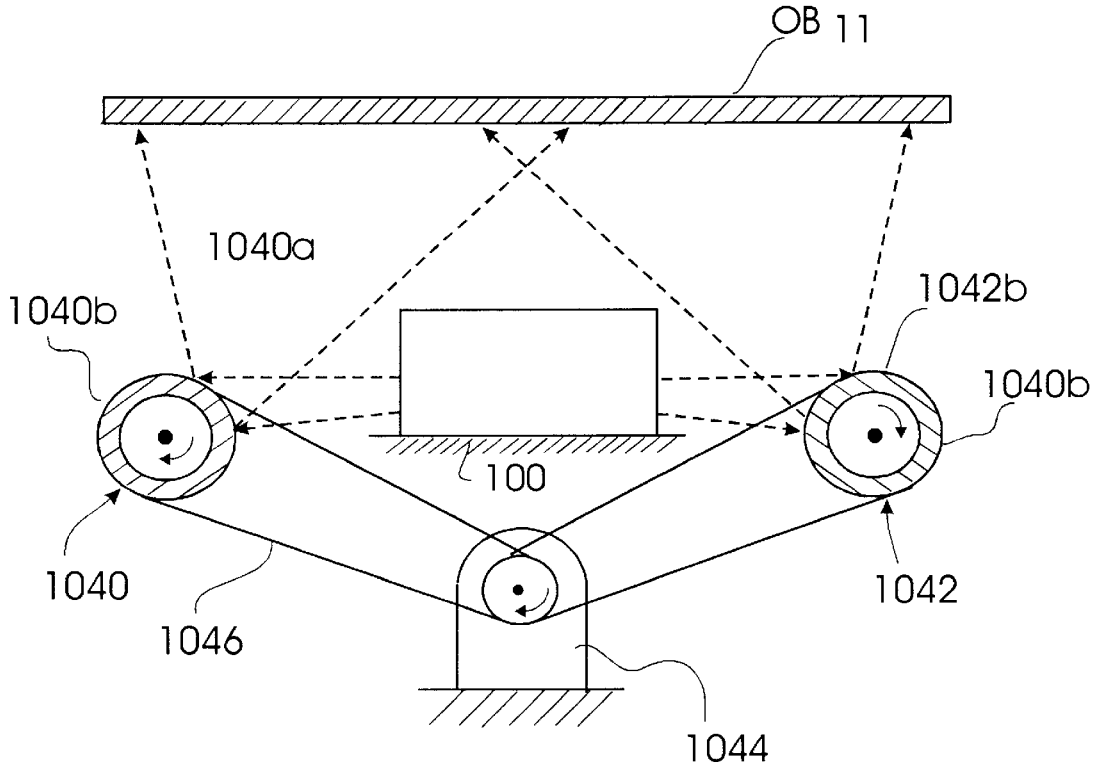
FIG. 19 is a view similar to FIG. 18 with target holders in the form of rotating cylindrical bodies.

An embodiment of FIG. 19 is similar to the one shown in FIGS. 18 and differs from it in that cylindrical target holders 1040 and 1042 are used instead of polygonal target holders. The cylindrical target holders 1040 and 1042 are rotated, e.g., by a motor 1044 via transmission belts 1046 and 1048. The cylindrical surfaces of target holders 1040 and 1042 supports cylindrical targets 1040*a*, 1040*b*, . . . and 1042*a*, 1042*b* . . . , respectively which are made of different sputterable materials such as Ni, Co., etc.

Sputtering conditions and composition of the coating on the surface of an object $OB_{11}$ can be adjusted by changing the speed of rotation of motor 1044 according to a program, installing targets of different materials, etc.

FIG. 20 is a schematic sectional view of a sputtering system with an ion beam $IB_{11}$ moveable with respect to a stationary targets 1050. The ion source 1000 of this embodiment is similar to similar to the one described in connection with FIGS. 4 and 5 and differs from it in that a closed-loop ion-emitting slit 1052 divides a housing 1054 into a first part 1054*a* and a second part 1054*b*, which are electrically isolated from each other by an insulation plate 1056. Slit 1052 has opposite sides 1052*a* and 1052*b* formed by said aforementioned parts 1054*a* and 1054*b*. One of these part, e.g., part 1054*a* is electrically connected to one end of an alternating voltage source 1058. The other end of this source is grounded at 1060.

When, during operation of ion source 1000, alternating voltage source 1058 is energized, this changes direction of the electric field of the source across ion-emitting slit 1052 with a desired frequency or in accordance with a given program. As a result, ion beam $IB_{11}$ begins to scan the surface of target 1050. As in the previous embodiments, this target can consist of pieces of different materials for the formation of a multiple-component coating on the surface of the object.

Thus, it has been shown that the present invention provides an ion-beam source with a closed-loop configuration of the ion emitting slit or a plurality of slits which allow for treating the entire outer or inner surface of a tubular object with a continuous radially-emitted ion beams. The ion source of the invention allows for treating the entire outer or inner surface of an object in one pass. The invention also provides a method for continuously treating the entire inner or outer surfaces of objects with the use of a closed-loop radially emitting slits.

Although the invention has been shown in the form of specific embodiments, it is understood that these embodiments were given only as examples and that any changes and modifications are possible, provided they do not depart from the scope of the appended claims. For example, the cathode housings of ion sources, as well as ion emitting slits, and anodes may have configurations other than oval and may be made circular, elliptic, or non-tubular at all. The closed-loop slits themselves may be circular, elliptic or irregular in shape. Anodes may be secured inside cathode housings to a block of dielectric materials by fasteners, press fits, glues, etc. The objects to be treated may be fixed by bolts which, at the same time, may be used for grounding the objects. Working media may comprise different gases or their combinations. The objects to be treated may be different in shape and dimensions and may be subjected to different sequence of treatment. The permanent magnet may be in physical contact with anode than with cathode, but in this case the magnet should not have contact with the cathode. In the sputtering system, the targets can be supported by an endless belt that moves with respect to the ion beam. Objects may comprise thin moveable tapes or disks for deposition of thin coatings onto their surfaces. An electromagnet may be used instead of a permanent magnet.

What is claimed is:

1. An ion source with propagation of ions in the electron drift plane for emitting ion beams in a radial direction toward an object located in a position reachable by said ion beams, comprising:

hollow housing that functions as a cathode of said ion beam source, said hollow housing having a side wall;

anode spaced from said cathode at an anode-cathode distance to form an ionization space therebetween for ionization and acceleration of ions formed in said space during operation of said ion beam source;

magnetic field generating means in magnetoconductive relationship with said anode;

electric power supply means for maintaining said anode under a positive charge and said cathode under a negative charge;

at least one closed-loop ion-emitting slit passing through said side wall of said hollow housing in the direction which coincides with said electron drift plane; and a working medium supply means for the supply of a working medium into said hollow housing.

2. The ion source of claim 1, wherein said anode is located inside of said hollow housing, and said magnetic field generating means are located inside of said anode and are spaced from said anode to prevent electrical contact therebetween, said radial direction being a radial outward direction.

3. The ion source of claim 2, wherein said hollow housing, said anode, and said magnetic field generating means have a cross-section selected from a group consisting of circular and substantially oval configurations.

4. The ion source of claim 3, wherein said hollow housing has a plurality of said ion-emitting slits which pass through said side wall, said anode and said magnetic field generating means being common for said plurality of ion-emitting slits.

5. The ion source of claim 1, wherein said anode is located inside of said hollow housing, and said magnetic field generating means are located outside of said hollow housing in electric contact therewith, said radial direction being a radial outward direction.

6. The ion source of claim 5, wherein said hollow housing, said anode, and said magnetic field generating means have a cross-section selected from a group consisting of circular and substantially oval configurations.

7. The ion source of claim 6, wherein said hollow housing has a plurality of said ion-emitting slits which pass through said side wall, said anode and said magnetic field generating means being common for said plurality of ion-emitting slits.

8. The ion source of claim 1, wherein said anode is located outside of said hollow housing, and said magnetic field generating means are located outside of said anode and are spaced from said anode to prevent electrical contact therebetween, said radial direction is a radial inward direction.

9. The ion source of claim 8, wherein said hollow housing has a central opening for insertion of said object to be treated by said ion beams which are emitted in said radial inward direction onto said object, and said anode and said magnetic field generating means forming a closed space into which said working medium is supplied for the supply to said ion-emitting slits.

10. The ion source of claim 9, wherein said hollow housing, said anode, and said magnetic field generating means have a cross-section selected from a group consisting of circular and substantially oval configurations.

11. The ion beam source of claim 10, wherein said hollow housing has a plurality of said ion-emitting slits which pass through said side wall, said anode and said magnetic field generating means being common for said plurality of ion-emitting slits.

12. An ion source with propagation of ions in the electron drift plane for emitting ion beams in a radial direction toward a tubular object located in a position reachable by said ion beams, comprising:

a closed tubular hollow housing that functions as a cathode of said ion beam source, said closed hollow tubular housing having a side wall;

an annular anode spaced from said cathode at an anode-cathode distance to form an ionization space therebetween for ionization and acceleration of ions formed in said space during operation of said ion beam source;

at least one permanent magnet in magnetoconductive relationship with said annular anode;

electric power supply means for maintaining said anode under a positive charge and said cathode under a negative charge;

at least one closed-loop ion-emitting slit passing through said side wall of said hollow housing in the direction which coincides with said electron drift plane; and a working medium supply means for the supply of a working medium into said hollow housing.

13. The ion source of claim 12, wherein said annular anode is located inside of said hollow housing, and said at least permanent magnet is located inside of said annular anode and is spaced from said anode to prevent electrical contact therebetween, said radial direction being a radial outward direction.

14. The ion source of claim 13, wherein said hollow housing, said anode, and permanent magnet have a cross-section selected from a group consisting of circular and substantially oval configurations.

15. The ion source of claim 14, wherein said tubular hollow housing has a plurality of said ion-emitting slits which pass through said side wall, said anode and said at least one permanent magnet being common for said plurality of said ion-emitting slits.

16. The ion source of claim 12, having two permanent magnets, said anode being located inside of said tubular hollow housing, each said permanent magnet being located outside of said hollow housing and being in electric contact therewith, said radial direction being a radial outward direction.

17. The ion source of claim 16, further having means for adjusting position of at least one of said permanent magnets with respect to said ion-emitting slit.

18. The ion source of claim 16, wherein said hollow housing, said anode, and said two permanent magnets have a cross-section selected from a group consisting of circular and substantially oval configurations.

19. The ion source of claim 18, wherein said tubular hollow housing has a plurality of said ion-emitting slits which pass through said side wall, said anode and said two permanent magnets being common for said plurality of ion-emitting slits.

20. The ion source of claim 12, wherein said anode is located outside of said tubular hollow housing, and said at least one permanent magnet is located outside of said anode and is spaced from said anode to prevent electrical contact therebetween, said radial direction being a radial inward direction.

21. The ion source of claim 20, wherein said tubular hollow housing has a central opening for insertion of said object to be treated by said ion beams which are emitted in said radial inward direction onto said object; said tubular hollow housing and said at least one permanent magnet forming a closed space into which said working medium is supplied.

22. The ion source of claim 21, wherein said hollow housing, said anode, and said at least one permanent magnet have a cross-section selected from a group consisting of circular and substantially oval configurations.

23. The ion beam source of claim 22 wherein said tubular hollow housing has a plurality of said ion-emitting slits which pass through said side wall, said anode and said permanent magnet being common for said plurality of ion-emitting slits.

24. A method for treating simultaneously the entire surface of a tubular object with ion beams, comprising the steps of:

providing a cold-cathode ion beam source having a hollow housing with at least one closed-loop ion-emitting slit passing through said hollow housing, an anode, a cathode, a magnetic field generating means, a working medium supply source, and an electric power source with a positive pole and a negative pole;

connecting said cathode to said negative pole of said electric power source and said anode to said positive pole of said electric power source, thus generating an electric field;

generating a magnetic field by means of said magnetic field generating means, said magnetic field being crossed with said electric field so that electrons begin to drift in an electron drift plane in a closed path within said crossed electrical and magnetic fields;

and supplying said working medium into said hollow housing for generating and accelerating ions which are emitted through said at least one ion emitting slit in a direction which lies in said electron drift plane.

25. The method of claim 24, wherein said direction is a radial outward direction.

26. The method of claim 25, wherein said direction is a radial inward direction.

* * * * *